US005545839A

United States Patent [19]

Kawamura et al.

[11] Patent Number: 5,545,839

[45] Date of Patent: Aug. 13, 1996

[54] KEYBOARD MUSICAL INSTRUMENT WITH MOVABLE KEY BED FOR PERFORMING MUSIC WITHOUT ACOUSTIC SOUNDS

[75] Inventors: Kiyoshi Kawamura; Toshio Tajima; Shinya Koseki, all of Shizuoka-ken, Japan

[73] Assignee: Yamaha Corporation, Japan

[21] Appl. No.: 343,130

[22] Filed: Nov. 22, 1994

[30] Foreign Application Priority Data

Nov. 30, 1993 [JP] Japan ..... 5-325808
Feb. 18, 1994 [JP] Japan ..... 6-043347

[51] Int. Cl.[6] ..... G10D 15/00; G10F 1/22

[52] U.S. Cl. ..... 84/171; 84/2; 84/23; 84/33; 84/216

[58] Field of Search ..... 84/171, 170, 172, 84/216, 217, 218, 219, 21, 23, 33, 34, 432, 2

[56] References Cited

U.S. PATENT DOCUMENTS 4,469,000 9/1984 Fujiwara et al. ..... 84/171
5,428,186 6/1995 Kaneko et al. ..... 84/171

FOREIGN PATENT DOCUMENTS 6-102861 4/1994 Japan .

*Primary Examiner*—Cassandra C. Spyrou
*Attorney, Agent, or Firm*—Graham & James

[57] ABSTRACT

A keyboard musical instrument lowers a key bed together with a keyboard, key action mechanisms and hammer mechanisms in a silent mode, and a stopper mechanism and a make-up mechanism cause the depressed keys to actuate the key action mechanisms and damper mechanisms as similar to an acoustic sound mode, thereby allowing a player to feel the key touch usual in a performance without an acoustic sound.

7 Claims, 20 Drawing Sheets

KEYBOARD MUSICAL INSTRUMENT WITH MOVABLE KEY BED FOR PERFORMING MUSIC WITHOUT ACOUSTIC SOUNDS

FIELD OF THE INVENTION

This invention relates to a keyboard musical instrument and, more particularly, to a keyboard musical instrument changeable between an acoustic sound mode to an electronic sound mode through a movement of a key bed.

DESCRIPTION OF THE RELATED ART

A standard acoustic piano such as a grand piano and an upright piano is equipped with a soft pedal for lessening the volume of sounds produced through vibrations of the sets of strings. The soft pedal and the associated drive link mechanism of the grand piano laterally shifts the key bed, and the hammers are offset from the normal position for striking a smaller number of each set of strings.

Various new keyboard musical instruments have been proposed. One of the new keyboard musical instrument is disclosed in U.S. Pat. No. 2,250,065, and the new keyboard musical instrument includes a grand piano, and a pull-up mechanism is incorporated therein for lifting up the hammer assemblies. While the pull-up mechanism lifts up the hammer assemblies, the jacks miss the hammers, and the hammers are never driven for rotation. Sensors monitor the key motions, and a tone controlling circuit produces electronic sounds corresponding to the depressed keys instead of the acoustic sounds.

However, the pull-up mechanism spoils the key touch, because the jacks do not escape from the hammer butts.

The present inventors have proposed a solution. The solution is to provide a stopper which causes the hammers to rebound thereon before strikes at the strings, thereby allowing a player to perform a music with either acoustic or electronic sounds. The jacks escape from the hammer butts regardless of the position of the stopper, and the player theoretically feels the key touch as usual. The proposed solution resulted in Japanese Patent Application No. 4-215400.

However, the key touch of an actual keyboard musical instrument is different from the acoustic piano, because the hammers rebounds on the stopper about 10 millimeters before the strings. If the distance between the hammer head and the strings at the rebound is shorter than the distance, the hammer heads are liable to touch the associated strings due to deformation of parts of the hammers, and noise is mixed in the electronic sounds. Therefore, the distance between the hammer heads and the strings is hardly shrunk, and the jacks are expected to escape from the hammer butts or the hammer rollers before the rebound.

On the other hand, the distance of a standard acoustic piano is regulated to 2 millimeters to 3 millimeters, and the distance of the proposed keyboard musical instrument is much longer than that of the standard acoustic piano. This means that the jacks need to escape from the hammer butts or hammer rollers earlier than those of the standard acoustic piano, and the player feels the key touch shallow. Moreover, the jack early escaping gives a smaller amount of kinetic energy to the hammer butt/hammer roller, and the impact on the strings is softer than the impact of the standard acoustic piano.

In order to further improve the key touch, the present inventors have proposed to change the escape timing. Namely, a movable spacer is provided for the regulating buttons, and the spacer is inserted into gaps between the toes of the jacks and the regulating buttons so as to allow the jacks to escape earlier in a performance without an acoustic sound. However, the player feels the key touch different between a performance with the acoustic sounds and a performance without an acoustic sound. Moreover, the keyboard musical instrument equipped with the movable spacer can not appropriately respond to a repetition in both performances with and without an acoustic sound, because a drop screw can not be regulated.

In order to give the standard key touch to a player regardless of the stopper, the present inventors has proposed to provide a movable key bed on a stationary key bed for changing the distance between the hammer heads at the home position and the strings through an up-and-down motion of the movable key bed. The keyboard musical instrument with the movable key bed is disclosed in Japanese Patent Application No. 4-279470. The movable key bed increases the distance between the hammer heads and the strings in a performance without an acoustic sound, and allows a stopper to block the strings from the hammer heads without change of the escape timing. This results in the standard key touch in both performance with and without an acoustic sound.

However, a malfunction takes place in the damper action. Namely, when the movable key bed is downwardly moved for increasing the distance between the hammer heads and the strings, the damper mechanisms are undesirably spaced from the associated keys, and the depressed keys do not widely space the associated damper heads from the strings. In other words, the depressed key actuates the associated damper mechanism at a later point than a standard acoustic piano, and the player feels the key touch light.

SUMMARY OF THE INVENTION

It is therefore an important object of the present invention to provide a keyboard musical instrument which allows a player to feel a key touch constant and repeat a quick fingering.

In accordance with the present invention, there is provided a keyboard musical instrument having at least an acoustic sound mode and a silent mode, comprising: an acoustic piano having a key bed structure having a movable key bed movable with respect to a stationary member of the acoustic piano, a keyboard mounded on the movable key bed and implemented by a plurality of keys turnable with respect to the movable key bed and selectively depressed by a player in both acoustic sound and silent modes, notes of a scale being respectively assigned to the plurality of keys, a plurality of key action mechanisms supported by the movable key bed and functionally connected to the plurality of keys, depressed keys of the plurality of keys actuating the associated key action mechanisms in both acoustic sound and silent modes, a plurality of hammer assemblies supported by the movable key bed and respectively associated with the plurality of key action mechanisms, the actuated key action mechanisms functionally connected to the depressed keys driving the associated hammer assemblies for rotation in both acoustic sound and silent modes, a plurality of sets of stings stationary with respect to the stationary member and respectively associated with the plurality of keys, the plurality of sets of strings being stretched over the plurality of hammer assemblies, the hammer assemblies driven by the actuated key action mechanisms striking the associated sets of strings for producing acoustic sounds having the notes identical with those of the depressed keys in the acoustic sound mode, and a plurality of damper mechanisms stationary with respect to the stationary member and respectively associated with the plurality of sets of strings, the depressed keys causing the associated damper mechanisms to leave the associated sets of strings in at least the acoustic sound mode; a stopper changed between a free position in the acoustic sound mode and a blocking position in the silent mode, the stopper in the free position allowing the hammer assemblies to strike the associated sets of strings, the hammer assemblies rebounding on the stopper in the blocking position without strike at the associated' set of strings; a change-over mechanism connected to the movable key bed, and operative to make the plurality of hammer assemblies close to the plurality of sets of strings in the acoustic sound mode and spaced from the plurality of sets of strings in the silent mode; a make-up mechanism decreasing gaps between the plurality of keys and the plurality of damper mechanisms in the silent mode; and an electronic sound generating system operative to produce electronic sounds having the notes identical with those of the depressed keys instead of the acoustic sounds in the silent mode.

BRIEF DESCRIPTION OF THE DRAWINGS

The feature and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
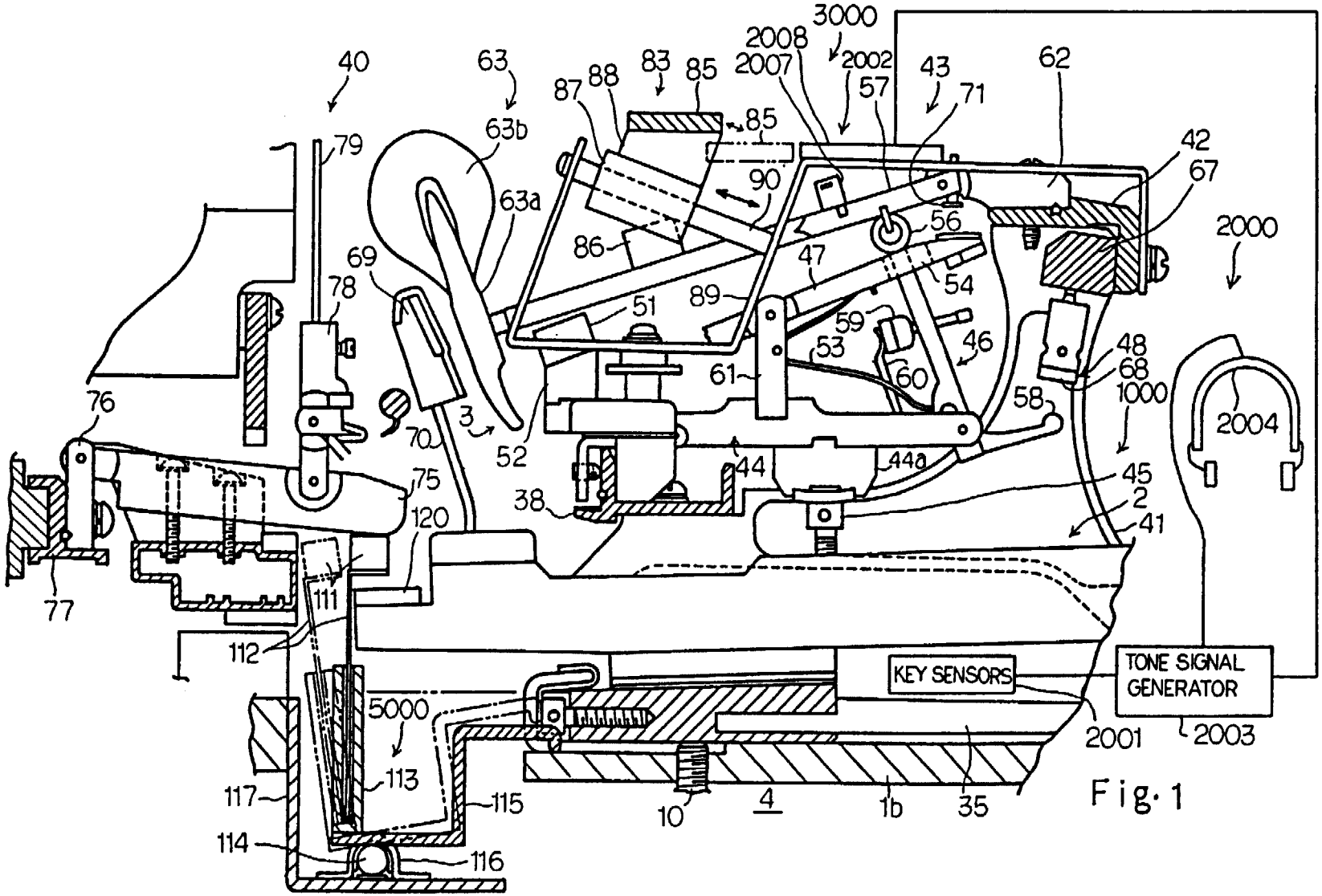
FIG. 1 is a partially cross-sectional side view showing a keyboard musical instrument according to the present invention in a silent mode.

Referring to FIGS. 1 to 7 of the drawings, a keyboard musical instrument embodying the present invention largely comprises a grand piano 1000, an electronic sound generating system 2000, a stopper mechanism 3000, a change-over mechanism 4000 and a make-up mechanism 5000. A player can perform a music with and without an acoustic sound, and the electronic sound generating system 2000 produces electronic sounds in response to a fingering of the player. When the keyboard musical instrument allows the player to perform a music with the acoustic sounds, the keyboard musical instrument is referred to as "acoustic sound mode". On the other hand, when the stopper mechanism 3000 allows a player to perform a music without an acoustic sound, the keyboard musical instrument is staying in "silent mode", and the electronic sound generating system 2000 can provide electronic sounds instead of the acoustic sound to the player.

In the following description, term "front" indicates a position closer to a player than a "rear" position, and directions "clockwise" and "counter clockwise" are determined on the sheet where the referenced figure is illustrated.

The grand piano 1 comprises a key bed structure 1 implemented by a stationary key bed 1*a* and a movable key bed 1*b* provided over the stationary key bed 1*a* for mounting a keyboard 2, a plurality of key action mechanisms 3 and other components as will be described hereinlater. The stationary key bed 1*a* is similar to that of a standard grand piano, and supports a wooden frame (not shown) and pedal mechanisms (also not shown). A space 4 takes place between the stationary key bed 1*a* and the movable key bed 1*b*, and the change-over mechanism 4000 is accommodated in the space 4 for changing the key bed structure 1 between the acoustic sound mode and the silent mode.

Figure 2:
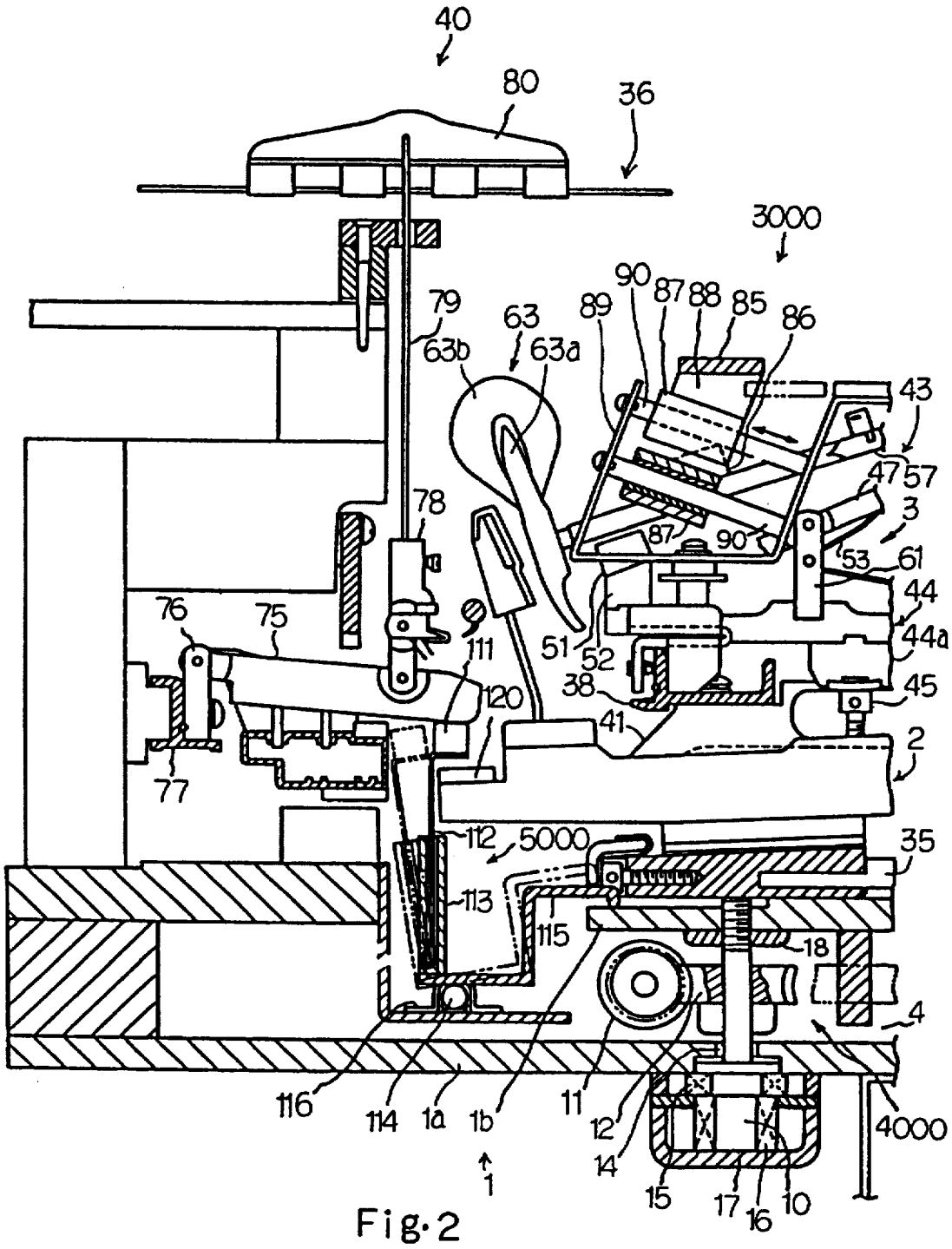
FIG. 2 is a partially cross-sectional side view showing essential parts of the keyboard musical instrument.
Figure 3:
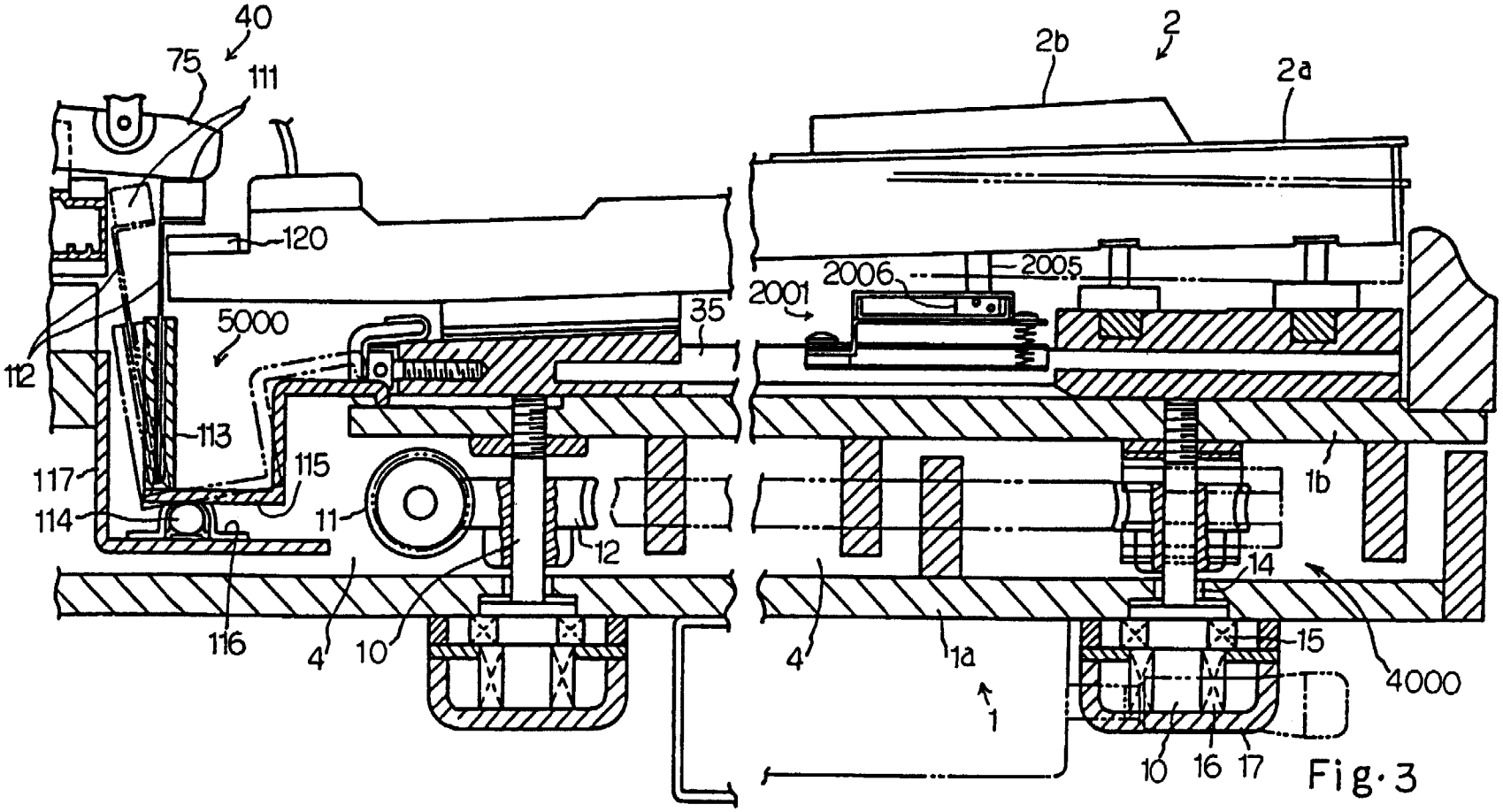
FIG. 3 is a partially cross-sectional side view showing a change-over mechanism for a key bed structure incorporated in the keyboard musical instrument.
Figure 4:
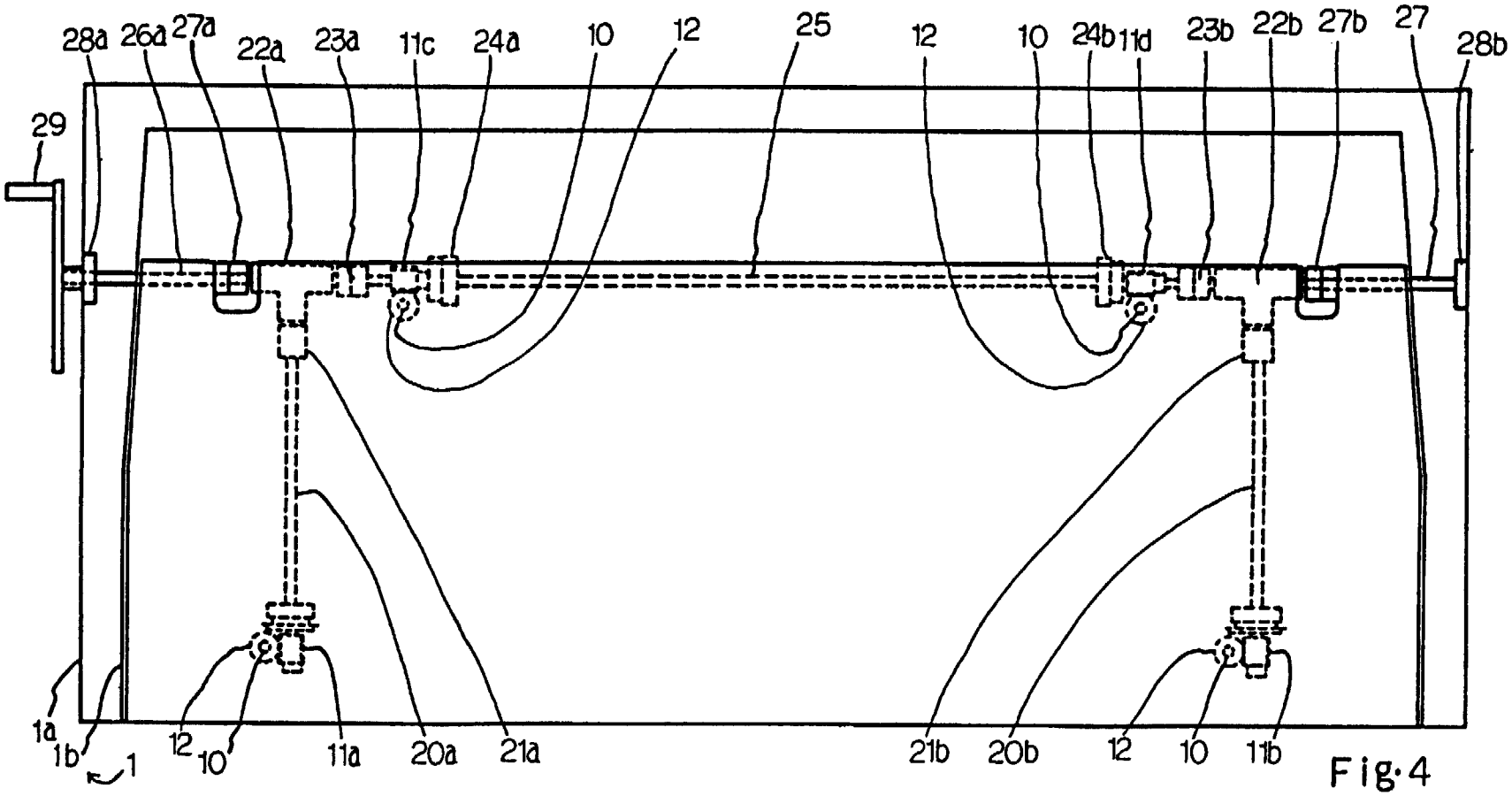
FIG. 4 is a plan view showing the change-over mechanism.
Figure 5:
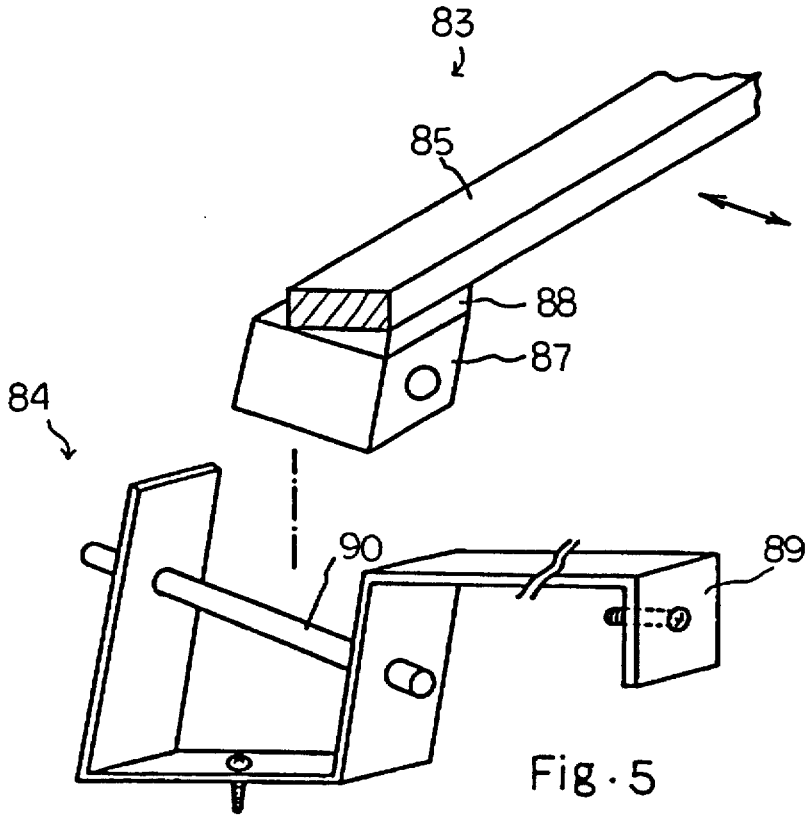
FIG. 5 is a fragmentary perspective view showing a stopper incorporated in the keyboard musical instrument.

As will be better seen from FIGS. 2 to 4, the change-over mechanism 4000 comprises four rotatable shaft members 10, worms 11 and worm wheels 12. The worm wheels 12 are respectively fixed to the rotatable shaft members 10, and is driven by the worms 11. The four rotatable shaft members 10 are provided at four corners of the key bed structure 1, and project through holes 14 formed in the stationary key bed 1*a*. The lower portions of the rotatable shaft members 10 are supported by bearing units 15 and 16, and the bearing units 15 and 16 are retained by holders 17 attached to the lower surface of the stationary key bed 1*a*. The four sets of bearing units 15 and 16 are strong enough to support the total weight of the movable key bed 1*b*, the keyboard 2, the key action mechanisms 3 and the other parts mounted on the movable key bed 1*b*. The upper end portions of the rotatable shaft members 10 are threaded, and pass through the movable key bed 1*b*. Nuts 18 are respectively engaged with the threaded upper portions, and are fixed to the lower surface of the movable key bed 1*b*. The movable key bed 1*b* is maintained in parallel to the stationary key bed 1*a*, and the gap between the stationary key bed 1*a* and the movable key bed 1*b* is changeable. Namely, if the rotatable shaft members 10 are driven for rotation, the nuts 18 and the movable key bed 1*b* are pushed up or down depending upon the rotational direction of the shaft members 10, and the movement of the movable key bed 1*b* is about 10 millimeters in this instance.

The worms 12 are fixed to the rotatable shaft members 10 under the nuts 18, and the worms on the front side, which are labeled with "11*a*" and "11*b*" in FIG. 4, are coupled to front ends of worm shaft members 20*a* and 20*b*, respectively, and the word shaft members 20*a* and 20*b* in turn are coupled at the respective rear ends thereof through coupling units 21*a* and 21*b* to bevel gear units 22*a* and 22*b*. On the other hand, the worms on the rear side, which are labeled with "11*c*" and "11*d*", are coupled through coupling units 23*a* and 23*b* to the bevel gear units 22*a* and 22*b*, and are, in turn, coupled through bearing units 24*a* and 24*b* to both ends of a shaft member 25. Rotatable shaft members 26*a* and 26*b* are coupled through respective coupling units 27*a* and 27*b* to the bevel gear units 22*a* and 22*b*, and are rotatably supported by bearing units 28*a* and 28*b*. A wheel member 29 is fixed to the rotatable shaft member 26*a*, and is manipulative by a player.

If the player wants to perform in the acoustic sound mode, the player rotates the wheel member 29 in one direction, and the rotation is transferred through the shaft member 26*a*, the bevel gear unit 22*a* and the worm/worm wheel 11*c* and 12 to the rotatable shaft member 10 and through the shaft member 26*a*, the bevel gear unit 22*a*, the worm 11*c*, the shaft member 25 and worm/worm wheel 11*d* and 12 to the rotatable shaft member 10. The rotation of the wheel member 29 is further transferred through the shaft members 26*a*, the bevel gear unit 22*a*, the worm shaft member 20*a* and the worm/worm wheel 11*a* and 12 to the rotatable shaft member 10 and through the shaft members 26*a*/25, the bevel gear unit 22*b*, the worm shaft member 20*b* and the worm/worm wheel 11*b* and 12 to the rotatable shaft member 10. Thus, the rotation of the wheel member 29 is transferred to the four rotatable shaft members 10 at the four corners of the key bed structure 1, and the movable key bed 1*b* is moved upwardly or downwardly depending upon the rotational direction of the wheel member 29. When the movable key bed 1*b* is downwardly moved, the keyboard musical instrument is changed from the acoustic sound mode to the silent mode.

In this instance, the player changes the movable key bed 1*b* by rotating the wheel member 29. However, an electronic motor may be coupled to the shaft member 26*a* or another appropriate shaft for changing the mode.

Referring to FIGS. 1 to 3 again, the keyboard 2 is implemented by white and black keys 2*a* and 2*b*, and a key frame 35 is provided over the movable key bed 1*b*. The white and black keys 2*a* and 2*b* are turnably supported by a balance rail (not shown) on the key frame 35, and are assigned notes of a scale. The white and black keys 2*a* and 2*b* are respectively associated with sets of strings 36, and the sets of strings 36 vibrate at respective fundamental frequencies corresponding to the notes of the scale. Though not shown in the figures, the strings 36 are horizontally stretched between tuning pins and frame pins (not shown), and are anchored to a frame (not shown).

A whippen rail 38 laterally extends under the strings 36, and the plurality of action mechanisms 3 are supported by the whippen rail 38. At the back of the whippen rail 38, a plurality of damper mechanisms 40 are provided for the sets of strings 36. While the associated key 2*a* or 2*b* is staying in the rest position, the damper mechanisms 40 are held in contact with the associated sets of strings 36, and do not allow the strings 36 to vibrate. If a key 2*a* or 2*b* is depressed, the depressed key 2*a* or 2*b* actuates the associated damper mechanism 40, and the damper mechanism 40 leaves the set of strings 36. As a result, the set of strings 36 is allowed to vibrate.

The whippen rail 38 is horizontally supported by three or four action brackets 41 which in turn is supported through bracket blocks (not shown) by the key frame 35. When a soft pedal (not shown) is pressed down, the key frame 35 is laterally moved for lessening the volume of the acoustic sounds. A shank flange rail 42 is provided in front of the whippen rail 38, and laterally extends in parallel thereto.

The action mechanisms 3 are similar in structure to one another, and is associated with one of the hammer assemblies 43. Each action mechanism 3 comprises a whippen assembly 44 pushed up by a capstan screw 45 implanted into the associated key 2*a* or 2*b*, a jack 46 rotatably supported by the whippen assembly 44 for driving the associated hammer assembly 43, a repetition lever 47 for receiving the hammer assembly 43 on the way to the home position and a regulating assembly 48 for causing the jack 46 to escape from the hammer assembly 43.

The whippen assembly 44 is rotatably supported through a flange (not shown) by the whippen rail 38, and has a whippen heel 44*a* in contact with the capstan screw 45. A hammer shank stop felt 51 is provided on the rear side of the whippen assembly 44, and is fixed through a whippen block 52 to the whippen assembly 44.

The jack 46 is an L-shape, and the bending portion is rotatably connected to the front end potion of the whippen assembly 44. A repetition spring 53 urges the jack 46 to rotate in the counter clockwise direction. The long portion of the jack 46 passes through a hole 54, and comes into contact with a hammer roller 56 rotatably supported by a hammer shank 57 of the hammer assembly 43. The short portion of the jack 46 has a toe 58, and the toe 58 is placed under the regulating assembly 48. A jack button 59 backwardly projects from the long portion of the jack 46, and is in contact with a jack stop spoon 60 implanted into the whippen assembly 44.

The repetition lever 57 is turnably supported by a repetition lever flange 61 connected to an intermediate portion of the whippen assembly 44, and is urged to rotate in the counter clockwise direction by the repetition spring 53. Though not shown in the figures, a repetition stop button is provided on the rear end portion of the repetition lever 47, and is pressed against the whippen assembly 44 by the elastic force of the repetition spring 53.

The hammer assembly 43 comprises the hammer roller 56, the hammer shank 57 turnably supported by a hammer shank flange 62 fixed to the hammer shank rail 42, a hammer wood 63*a* fixed to the leading end of the hammer shank 57 and a hammer head 63*b* attached to the hammer wood 63*a*, and the hammer wood 63*a* and the hammer head 63*b* form in combination a hammer 63. While the hammer assembly 43 is staying in the hole position, the jack 46 is in contact with the hammer roller 56.

When the key 2*a* or 2*b* is depressed by a player, the capstan screw 45 pushes up the whippen assembly 44, and the whippen assembly 44 rotates in the counter clockwise direction. The jack 46 pushes up the hammer roller 56, and causes the hammer assembly 43 to rotate in the clockwise direction. When the toe 58 is brought into contact with the regulating button 48, the whippen assembly 44 upwardly pushed up starts the jack 46 to rotate in the clockwise direction against the repetition spring 53, and the jack 46 escapes from the hammer roller 56. The hammer assembly 43 is driven for rotation, and strikes the associated set of strings 36. In this instance, when the hammer head 63*b* reaches a point spaced from the strings 36 by 2 to 3 millimeters, the jack 46 escapes from the hammer roller 56, and the escape point is approximately equal to that of a standard grand piano.

After the strike at the strings 36, the hammer assembly 43 returns to the home position, and the hammer roller 56 is received by the repetition lever 47 on the way to the home position. The repetition spring 53 absorbs the kinetic energy of the hammer assembly 47, and makes the hammer assembly 43 ready for strike again. For this reason, the repetition lever 47 and the repetition spring 53 allow a player to quickly repeat the fingering. The jack 46 comes into contact with the hammer roller 56 again, Thus, the keyboard 2, the key action mechanisms 3, the hammer assemblies 43 and the damper assemblies 40 allows the sets of strings 36 to vibrate for producing the acoustic sounds in the acoustic sound mode. Even though the grand piano enters into the silent mode, the keyboard 2, the key action mechanisms 3, the hammer assemblies 43 and the damper assemblies 40 behave as similar to the acoustic sound mode. However, the movable key bed 1*b* is lowered, and the distance between the hammer heads 63*b* and the strings 36 at the escape point is increased to about 10 millimeters, and the stopper mechanism 3000 blocks the sets of strings 36 from the hammers 63 as will be described hereinlater in detail. Thus, the escape point is identical with that of a standard grand piano, and the key touch is never changed between the acoustic sound mode and the silent mode.

The regulating assembly 48 comprises a regulating rail 67 shared between a plurality of key action mechanisms 3 associated with a part of the keyboard 2 and a regulating button 68 downwardly projecting from the regulating rail 67. The distance between the tow and the regulating button is adjusted in such a manner that jack 46 escapes from the hammer roller 56 when the hammer head 63*b* reaches a point 2 to 3 millimeters spaced from the strings 36. The distance is regulable by turning the regulating button 68. If the distance is increased, the regulating button 68 retards the escape. On the other hand, if the distance is decreased, the jack 46 escapes from the hammer roller 56 earlier than the standard escape timing.

A back check 69 is supported by a back check wire 70 implanted into the associated key 2*a* or 2*b*, and is operative to softly receive the hammer wood 63*a* on the way to the home position. A drop screw 71 is provided in the hammer shank flange 62 for regulating the returning motion of the hammer assembly 43. However, the hammer assemblies 43 similarly behave in both modes without regulation of the drop screw 71.

The damper assemblies 40 are similar to one another, and are respectively associated with the white and black keys 2*a* and 2*b*. Each of the damper assemblies 40 comprises a damper lever 75 turnably supported through a damper lever flange 76 by a damper rail 77, a damper block 78 upwardly projecting from the damper lever 75 and rotatable with respect to the damper lever 75, a damper wire 79 upwardly projecting from the damper block 78 and a damper 80 connected to the upper end of the damper wire 79. The self-weight of the damper assembly 40 presses down the damper head 80, and the damper head 80 is held in contact with the associated set of strings 36. Therefore, the strings 36 are not allowed to vibrate until the damper head 80 leaves the strings.

The damper lever 75 extends toward the keys 2*a* or 2*b*, and the leading end of the damper lever 75 is over the rear end of the key 2*a* or 2*b*. While the keyboard musical instrument is in the acoustic sound mode, the depressed key 2*a* or 2*b* pushes up the damper lever 75, and the damper head 80 leaves from the strings 36. As a result, when the hammer head 63*b* strikes the strings 36, the strings 36 vibrate for producing the acoustic sound.

The keyboard 2, the key action mechanisms 3, the hammer assemblies 43, the damper assemblies 40 and the strings 36 are similar to those of a standard grand piano.

The stopper mechanism 3000 blocks the strings 36 from the hammer heads 36*b* in the silent mode, and allows a player to perform a music with electronic sounds in cooperation with the change-over mechanism 4000 and the make-up mechanism 5000. The stopper mechanism 3000 comprises a stopper 83 (see FIG. 5) and a driving mechanism 84 (see FIG. 6) for changing the stopper 83 between a free position and a blocking position.

While the keyboard musical instrument is staying in the acoustic sound mode, the change-over mechanism 4000 keeps the movable key bed 1*b* in an upper position, and the stopper 83 is maintained in the free position. The movable key bed 1*b* in the upper position and the stopper 83 in the free position allow the hammer heads 63*b* to strike the associated sets of strings 36, and the strings struck by the hammer heads 63*b* vibrate for producing acoustic sounds.

On the other hand, when the keyboard musical instrument enters into the blocking position, the change-over mechanism 4000 lowers the movable key bed 1*b*, and the driving mechanism 84 changes the stopper 83 to the blocking position. Then, the hammer heads 63*b* are allowed to strike the associated sets of strings 36.

The stopper 83 has two stopper plates 85 extending in serial along the keyboard 2 and a plurality of felt members 86 respectively attached to the hammer shanks 57, and the stopper plates 85 are share between the hammer mechanisms 43 for the low-pitched tones and between the hammer mechanisms 43 for the high-pitched tones, respectively. The stopper plates 85 are provided between the hammer shanks 57 and the strings 36, and are moved in the fore-and-aft direction by means of the driving mechanism 84.

The driving mechanism 84 comprises sliders 87 fixed through spacers 88 to the stopper plates 85, bracket members 89 screwed to the whippen rail 38 and the shank flange rail 42 and guide rods 90 slidably supporting the sliders 87. The guide rods 90 are oblique in the fore-and-aft direction, and the rear end of each guide rod 90 is higher than the front end. As shown in FIG. 2, the sliders 87 around the boundary between the low-pitched tones and the high-pitched tones are lower than the sliders 87 on both sides.

The driving mechanism 84 further comprises a nob 92 slidable with respect to the stationary key bed 1*a*, two flexible wires 93 and 94 connected to the nob 92 and plate members 95 and 96 fixed to the stopper plates 85, and the flexible wires 93 and 94 are anchored to the plate members 95 and 96. Though not shown in the figures, spring members are connected to the plate members 95 and 96, and urge the plate members 95 and 96 toward the front end of the keyboard musical instrument. For this reason, the stopper plates 85 are moved to a position drawn in dots-and-dash line in FIG. 1, and are maintained out of the trajectories of the felt members 86. If the player pulls the nob 92 for the silent mode, the stopper plates 85 are backwardly moved as drawn by the real line in FIG. 1, and the felt members 86 rebound on the stopper plates 85 without impact on the strings 36. Each of the felt members 86 turns over a predetermined angle until the stopper plate 85 in the silent mode, and the predetermined angle is equal to an angle over which the hammer head 63*b* turns before the impact on the strings 36. In this instance, the hammer 63 travels over 47.5 millimeters in both acoustic sound and silent modes. For this reason, the jacks 46 escapes from the hammer rollers 56 at the same timing as a standard grand piano in both acoustic sound and silent modes, and the key touch is not changed between the acoustic sound mode and the silent mode.

In this instance, the stopper 83 is moved by means of the sliders 87, the guide rods 90, the nob 92, the flexible wires 93/94 and the plate members 95 and 96. However, a nob 92 may be replaced with a pedal, and an electric motor or a solenoid-operated actuator may drive the stopper 83. If an electric motor is used, a pinion and a rack may change a rotation to a reciprocal motion. On the other hand, a link mechanism may connect a solenoid-operated actuator to the stopper plates 85.

Figure 7:
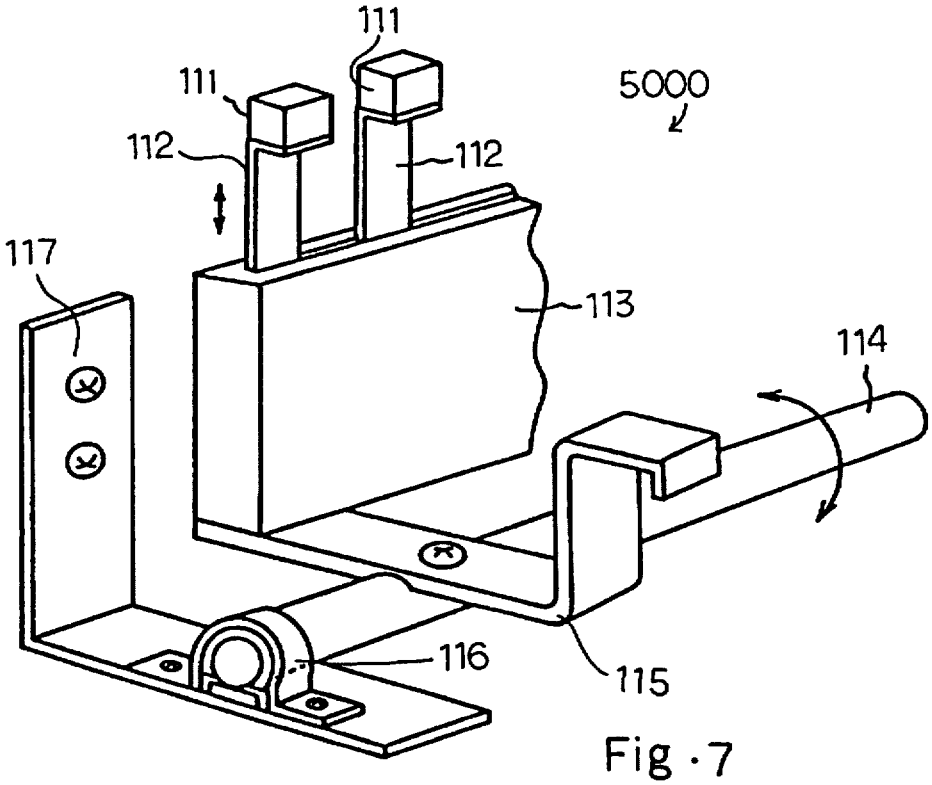
FIG. 7 is a perspective view showing a compensating mechanism for damper mechanisms incorporated in the keyboard musical instrument.
Figure 6:
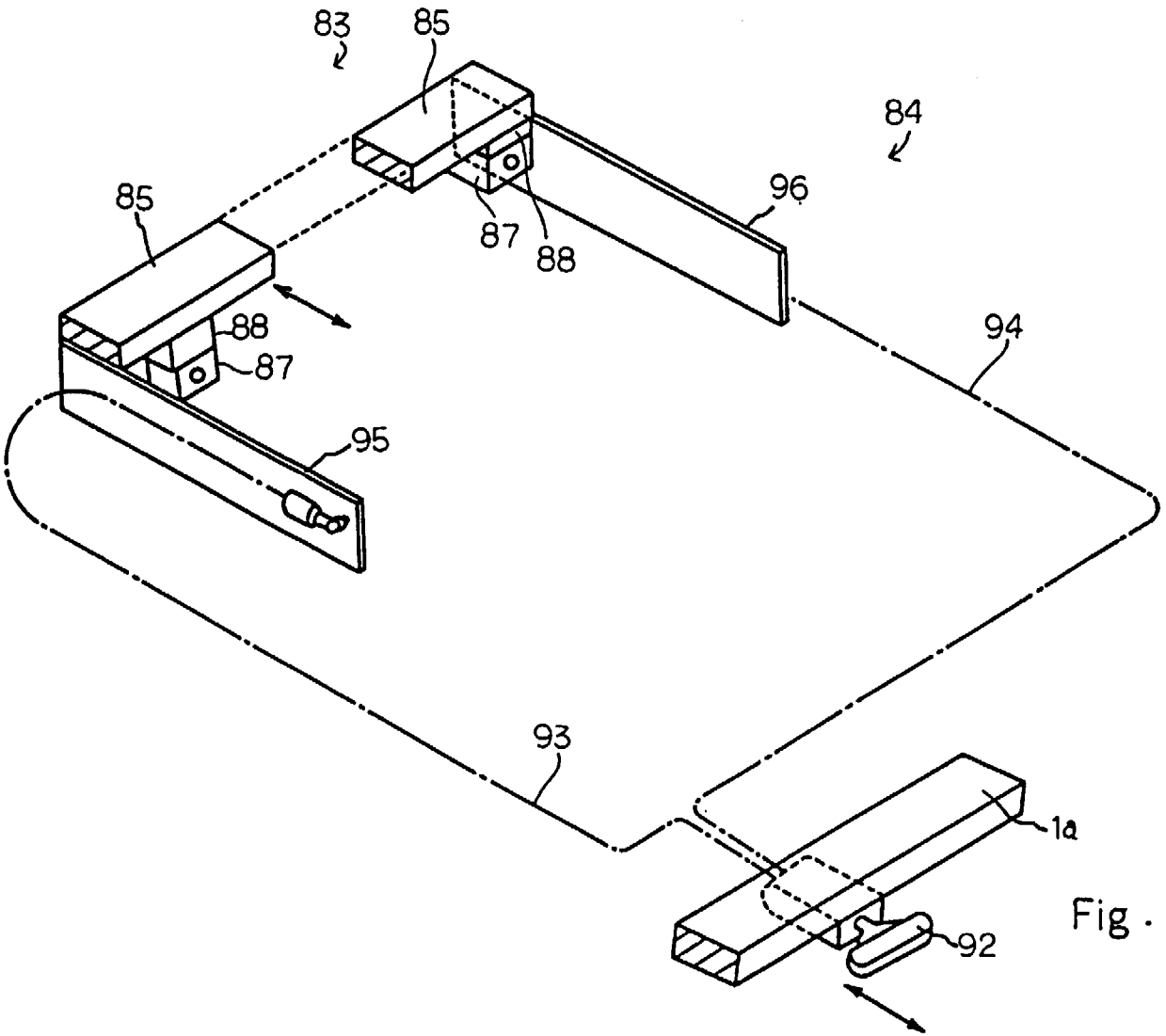
FIG. 6 is a driving mechanism for the stopper incorporated in the keyboard musical instrument.
Figure 8:
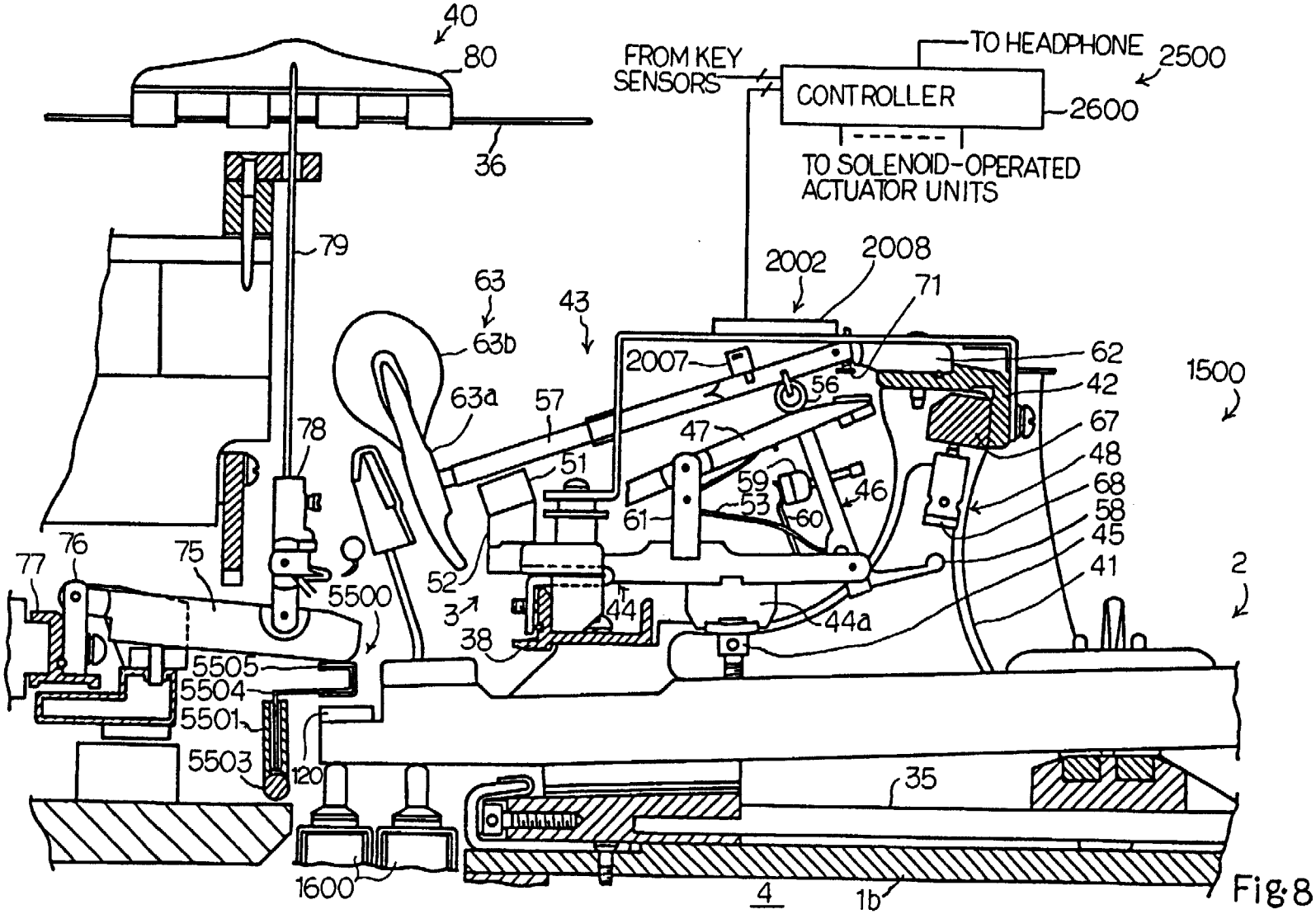
FIG. 8 is a partially cross-sectional side view showing another keyboard musical instrument according to the present invention.

As shown in FIG. 7, the make-up mechanism 5000 comprises a plurality of spacers 111 of felt respectively associated with the white and black keys 2*a* and 2*b*, a plurality of retaining members 112 for respectively retaining the spacers 111, a holder 113 slidably supporting the retaining members 112, a rotatable shaft member 114, a bracket member 115 connecting the holder 113 to the rotatable shaft member 114 and bearing units 116 rotatably supporting the shaft member 114 at both ends of the shaft member 114. The bearing units 116 are respectively mounted on bracket members 117, and the bracket members 117 are fixed to the stationary key bed 1*a*. The spacers 111 are arranged at intervals of 13 millimeters as similar to the key action mechanisms 3.

As will be seen from FIG. 1, the bracket member 115 is connected to the movable key bed 1*b*, and the holder 113 and the spacers 111 turn in synchronism with the up-and-down motion of the movable key bed 1*b*. The thickness of each spacer 111 is equal to the distance between the upper position and the lower position of the movable key bed 1*b*, and the spacers 111 compensate the downward motion of the movable key bed 1*b*.

While the movable key bed 1*b* is maintained in the upper position in the acoustic sound mode, the holder 113 and the retaining members 112 are declined, and the spacers 111 are moved out of the trajectories of felt members 120 attached to the rear end portions of the white and black keys 2*a* and 2*b*. When a key 2*a* or 2*b* is depressed, the felt member 120 is brought into contact with the damper lever 75, and upwardly pushes the damper lever 75. Then, the damper head 80 leaves the strings 36, and the strings are allowed to vibrate.

On the other hand, if the movable key bed 1*b* is lowered in the silent mode, the holder 113 and the retaining members 112 rotate in the clockwise direction, and the spacers 111 are placed beneath the damper levers 75, respectively. The distance between the lower surface of the retaining member 112 and the felt member 120 is approximately equal to the lower surface of the damper level 75 and the felt member 120 in the acoustic sound mode. When the key 2*a* or 2*b* is depressed, the felt member 120 is upwardly moved over a half or a third of the distance between the rest position and the end position, and is brought into contact with the retaining member 120. The distance between the rest position and the end position is about 47.5 millimeters. Then, the retaining member 112 upwardly slides together with the spacer 111, and transfers the upward motion of the felt member 120 to the damper lever 75. Thus, the make-up mechanism 5000 gives the load due to the damper mechanisms to the depressed keys 2*a* and 2*b* at the same timing as the acoustic sound mode, and the player feels the key touch in both acoustic sound and silent modes.

Turning back to FIGS. 1 to 3, the electronic sound generating system 2000 comprises an array of key sensors 2001 associated with the keyboard 2, an array of hammer sensors 2002 associated with the hammer assemblies 43, a tone signal generator 2003 connected to the key sensors 2001 and the hammer sensors 2002 and a headphone 2004 connected to the tone signal generator 2003. Each of the key sensors 2001 is implemented by a combination of a shutter plate 2005 fixed to one of the keys 2*a* and 2*b* and a photo-coupler 2006 (see FIG. 3), and a slit pattern in the shutter plate 2005 is varied for changing the bit pattern produced by the photo-coupler 2006. Each of the hammer sensors 2002 is also implemented by a shutter plate 2007 fixed to the hammer shank 57 and a photo-coupler 2008, and a slit pattern of the shutter plate 2007 is varied as similar to the shutter plate 2005. The photo-couplers 2006 and 2008 supply multi-bit digital signals indicative of the actual position of the associated keys 2*a*/2*b* and the hammer shanks 57 to the tone signal generator 2003, and the tone signals generator 2003 produces an audio signal on the basis of the multi-bit digital signals. The headphone 2004 produces the electronic sounds having the notes corresponding to the depressed keys 2*a*/2*b*, and a player can perform a music with the electronic sounds instead of the acoustic sounds in the silent mode. The electronic sound generating system may be similar to the system disclosed in Japanese Patent Publication of Unexamined Application No. 59-24894.

The electronic sound generating system 2000 may have a speaker system together with or instead of the headphone 2004, and the photo-couplers 2004 and 2008 may be replaced with switching elements.

Description is hereinbelow made on the acoustic sound and silent modes. While a player is performing a music in the acoustic sound mode, the stopper 83 is staying out of the trajectories of the felt members 86. The movable key bed 1*b* is maintained in the upper position, and the spacers 111 are out of the trajectories of the felt members 120.

However, if the player wants to perform a music in the silent mode, the player rotates the wheel member 29 for lowering the movable key bed 1*b*, and the spacers 111 are moved beneath the damper levers 75. The player pulls the nob 92, and the stopper 83 enters into the trajectories of the felt members 86.

The player selectively depresses the white and black keys 2*a* and 2*b*, and the key action mechanisms 3 are actuated by the depressed keys 2*a* and 2*b*. The felt members 120 push up the damper levers 75 through the spacers 111, and the player feels the load of the damper assemblies 40. The jacks 46 escape from the hammer rollers 56 at the same timing as in the acoustic sound mode, and the player feels the key touch as usual.

After the escape, the hammer assemblies 43 rotate in the clockwise direction, and rebound on the stopper plates 85 before impact on the strings 36. Even if the hammer shanks 57 are deformed, the hammer heads **63*b* do not strike the strings 36, because the movable key bed 1*b* has spaced the hammer assemblies 43 from the strings 36. The hammer assemblies 43** finally return to home positions.

On the other hand, the key sensors 2001 and the hammer sensors 2002 monitor the depressed keys **2*a* and 2*b* and the associated hammer assemblies 43. The motions of the keys 2*a*/2*b* and the motions of the hammer assemblies 43 are reported to the tone signal generator 2003, and the tone signal generator 2003 produces the audio signal for producing the electronic sound through the headphone 2004**.

As will be appreciate from the foregoing description, the stopper mechanism 3000, the movable key bed **1*b* associated with the change-over mechanism 4000 and the make-up mechanism 5000 cause the key action mechanisms 3 and the hammer assemblies 43 to give the unchanged key touch to the player both in acoustic sound and silent modes. Especially, the obliquely movable stopper plates 85 make the turning angle of the hammer assembly 43** equal between the acoustic sound mode and the silent mode, and the jack escapes from the hammer roller at a predetermined timing between the acoustic sound mode and the silent mode. This results in the unchanged key touch between the acoustic sound mode and the silent mode.

Second Embodiment

Turning to FIGS. 8 to 12 of the drawings, another keyboard musical instrument embodying the present invention largely comprises an automatic player piano 1500, an electronic sound generating system 2500, the stopper mechanism (not shown), a change-over mechanism 4500 and a make-up mechanism 5500. The automatic player piano 1500 is fabricated on the basis of the grand piano 1000, and solenoid-operated actuator units 1600 are provided on the stationary key bed **1*a* under the rear end portions of the white and black keys 2*a* and 2*b*. A controller 2600, the key sensors 2001 and the hammer sensors 2002 are shared between the automatic player piano 1500 and the electronic sound generating system 2500**.

The grand piano forming the parts of the automatic player piano are similar in structure to the grand piano 1000, and parts and mechanisms are labeled with the same references as those of the grand piano without detailed description.

The change-over mechanism 4500 is implemented by four jacks 4501 to 4504 (see FIG. 10), and the four jacks 4501 to 4504 are located as similar to the four rotatable shaft members 10. The shafts of the jacks 4503 and 4504 on the rear side are connected through a shaft member 4505, and the shaft member 4505 is further coupled to bevel gear units 4506 and 4507 and a wheel member 4508, and the bevel gear units 4506 and 4507 transfer the rotation of the shaft member 4505 to shaft members 4510 and 4511. The shaft members 4510 and 4511 are coupled to the shafts of the jacks 4501 and 4502, and rotations of the wheel member 4508 is concurrently transferred through the shaft members 4505, 4510 and 4502 and the bevel gear units 4506 and 4507 to the four jacks 4501 to 4504.

Figure 9:
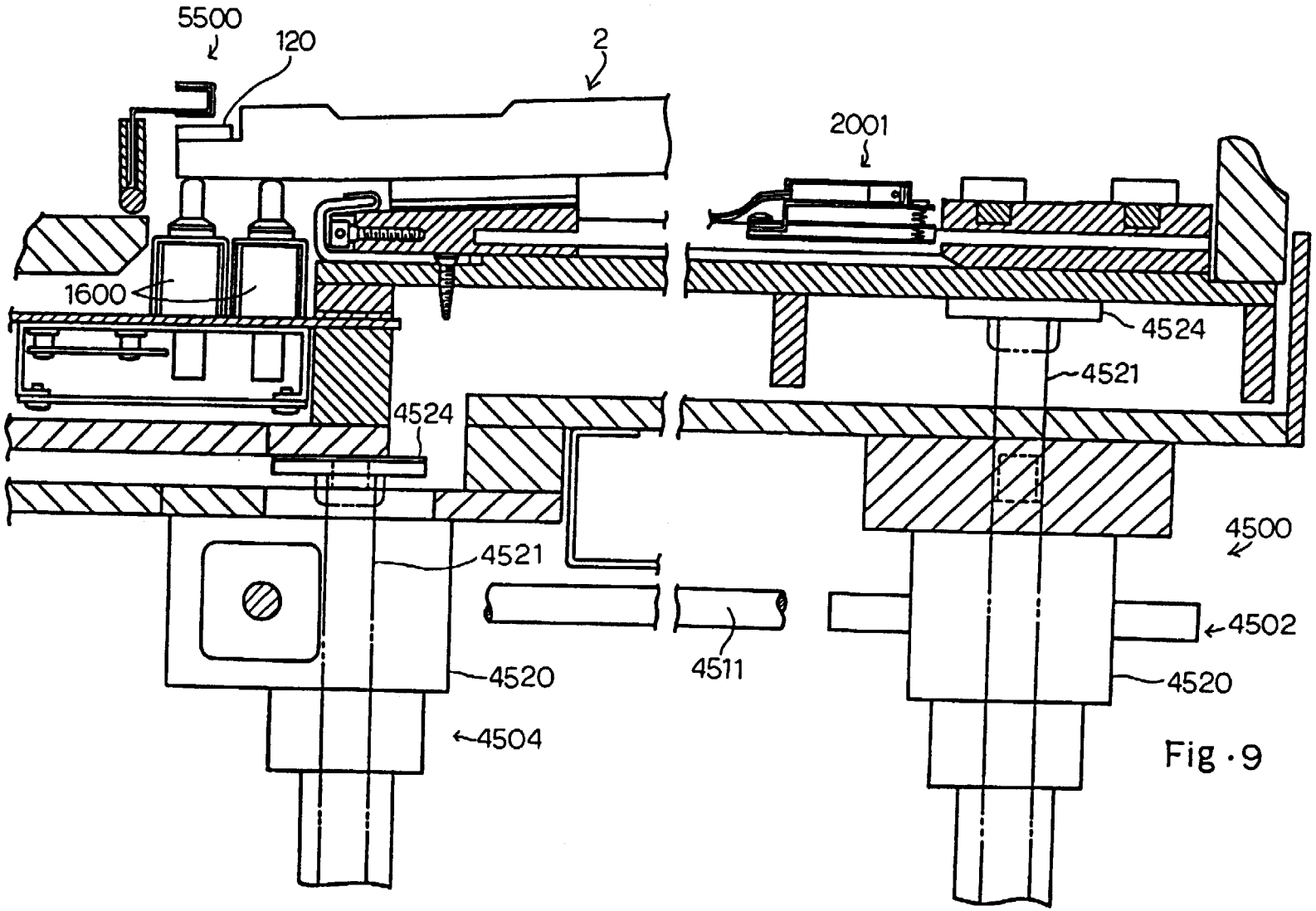
FIG. 9 is a partially cross-sectional side view showing a change-over mechanism incorporated in the keyboard musical instrument shown in FIG. 8.
Figure 10:
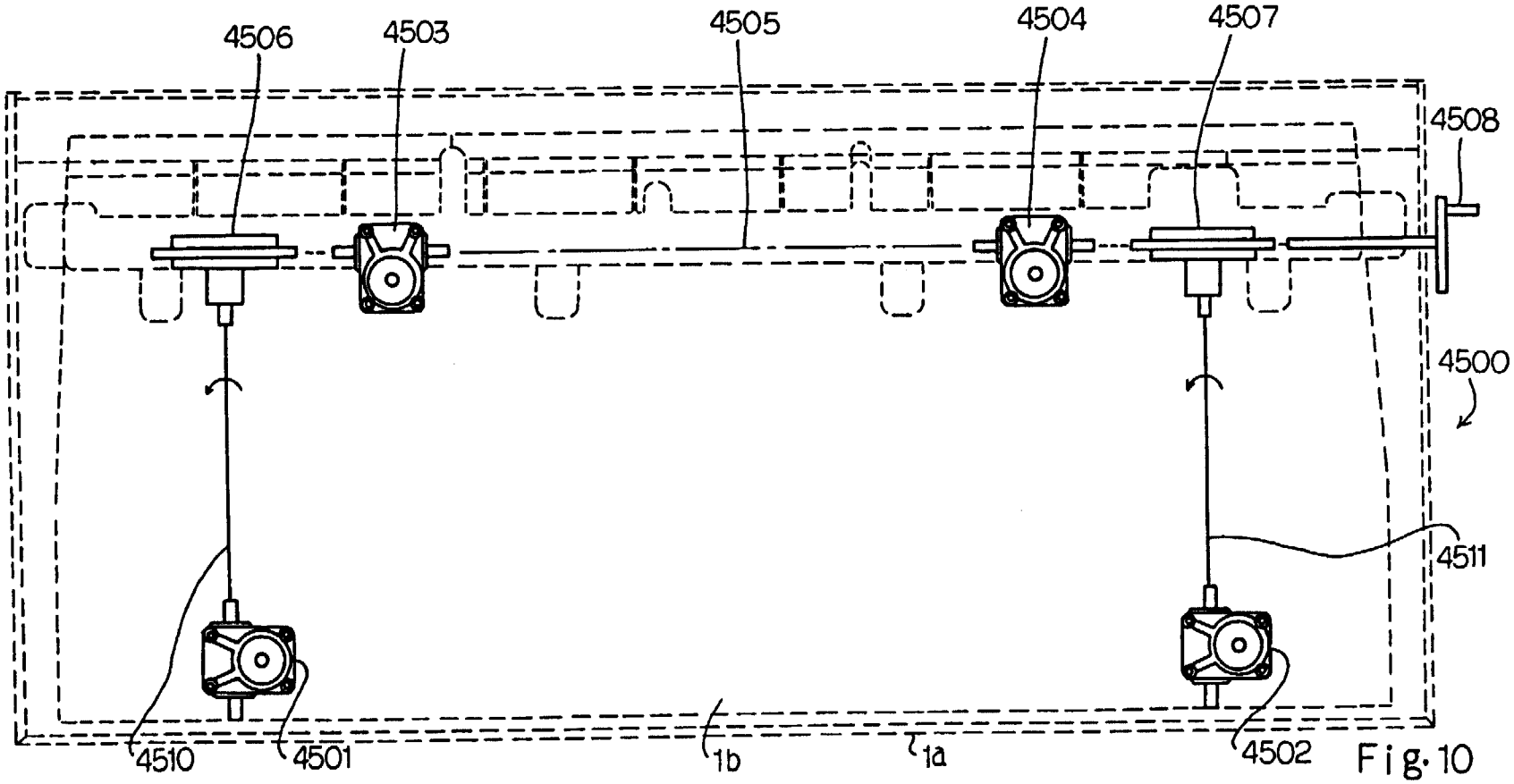
FIG. 10 is a plan view showing the change-over mechanism.
Figure 11:
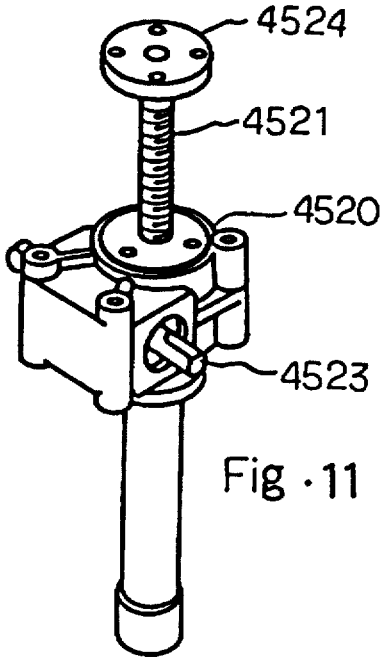
FIG. 11 is a perspective view showing a jack forming a part of the change-over mechanism.

Each of the jacks 4501 to 4504 has a stationary case 4520 having a threaded hole and fixed to the stationary key bed **1*a* as shown in FIG. 9, a threaded shaft member 4521 screwed into and out of the threaded hole of the stationary case 4520, a driving shaft 4523 for rotating the threaded shaft member 4521 and a flange 4524 for coupling the threaded shaft member 4521 to the movable key bed 1*b*. The drive shaft 4523 is connected to one of the shaft members 4505, 4510 and 4511, and the rotations of the driving shaft 4523 are covered to a straight motion in either upward or downward motion of the threaded shaft member 4521 and, accordingly, a straight motion of the movable key bed 1*b*. In this instance, the threaded shaft member 4521 and the movable key bed 1*b*** bi-directionally travels 10 millimeters.

While the keyboard musical instrument is staying in the acoustic sound mode, the jacks 4501 to 4504 keep the movable key bed **1*b* in an upper position, and the relative relation between the hammer assemblies 43 and the strings 36 is identical with that of a standard grand piano. The stopper is out of the trajectories of the felt blocks attached to the hammer shanks 57. In the acoustic sound mode, when a player depresses a key 2*a* or 2*b*, the key 2*a*/2*b* actuates the associated key action mechanism 3, and the jack 46 escapes from the hammer roller 56. Then, the player feels the unique piano key touch, and the hammer head 63*b* is driven for rotation toward the set of strings 36. The hammer head 63*b* strikes the strings, and the strings vibrate for producing the acoustic sound having the note identical with the depressed key. After the impact, the hammer head 63*b* rebounds, and the hammer assembly 43** returns to the home position.

On the other hand, if the player wants to perform a music without an acoustic sound, i.e., in the silent mode, the movable key bed **1*b* is lowered for spacing the hammer heads 63*b* apart from the sets of strings 36, and the stopper is moved into the trajectory of the felt member on the hammer shank 57. A depressed key 2*a*/2*b* actuates the key action mechanism 3, and the jack 46 escapes from the hammer roller 56 at the same timing as the escape point in the acoustic sound mode. For this reason, the player feels the piano key touch, and the hammer assembly 43 is driven for rotation. The felt member on the hammer shank 57 rebounds on the stopper, and the hammer head 63*b* does not strike the strings 36 because of the increased space between the hammer head 63*b* and the strings 36. After the rebound, the hammer assembly 43** returns to the home position.

Figure 12:
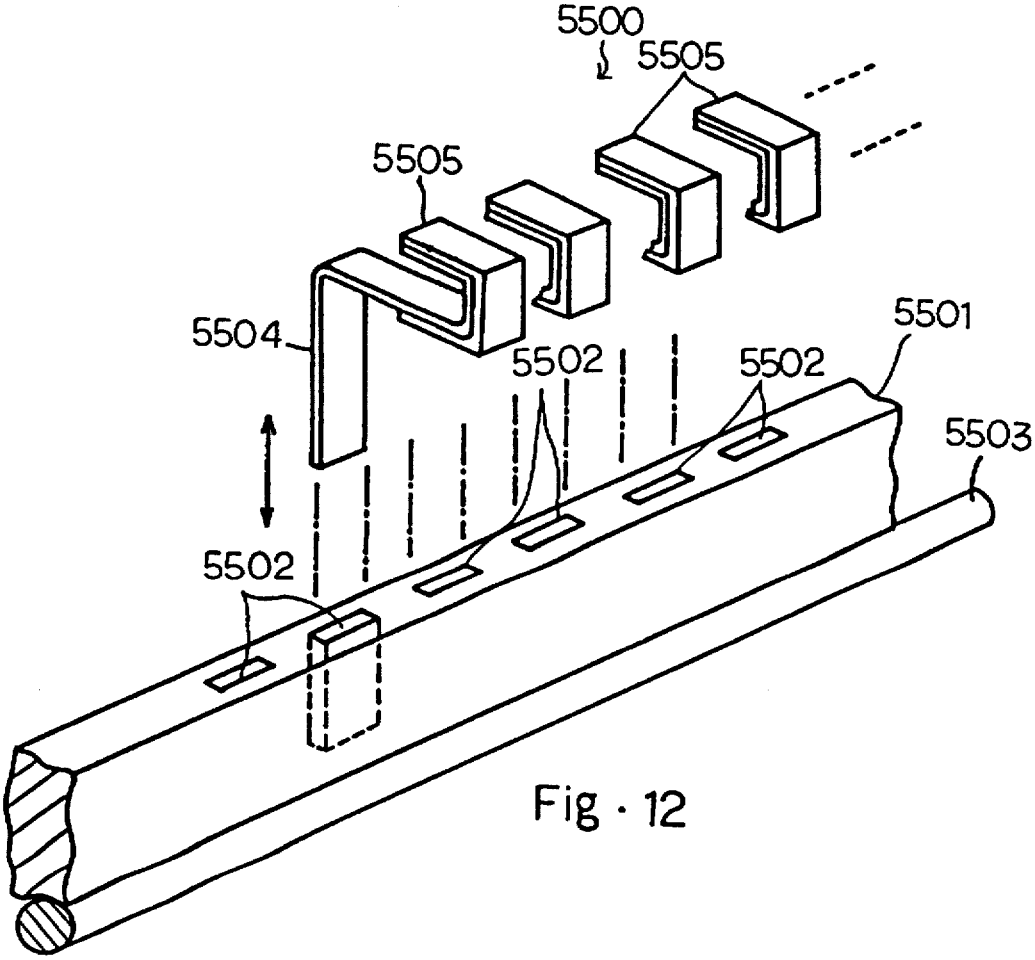
FIG. 12 is a fragmentary perspective view showing a make-up mechanism incorporated in the keyboard musical instrument shown in FIG. 8.

FIG. 12 shows the make-up mechanism 5500 comprising a holder 5501 having slots 5502 at a predetermined intervals of 13 millimeters, a shaft member 5503 fixed to the bottom surface of the holder 5501, a plurality of sliders 5504 slidable in the slots 5502, respectively and spacers 5505 respectively fixed to the sliders 5504. Though not shown in the figures, the shaft member 5503 is connected to a nob, a wheel or an electric motor so that the shaft member 5503 and, accordingly, the spacers 5505 are angularly moved as similar to the make-up mechanism 5000. Namely, while the keyboard musical instrument is staying in the acoustic sound mode, the spacers 5505 are maintained out of the trajectories of the felt members 120, and the rear end portions of the depressed white and black keys **2*a* and 2*b* push up the damper levers 75 through the felt members 120. On the other hand, when a player wants perform a music without an acoustic sound, the player causes the shaft member 5503 to move the spacers 5505 beneath the damper levers 75, and the felt members 120 push up the damper levers 75 through the spacers 5505** at the same timing as in the acoustic sound mode.

Various modifications of the make-up mechanism are described hereinbelow with reference to FIGS. 13 to 30.

Figure 13:
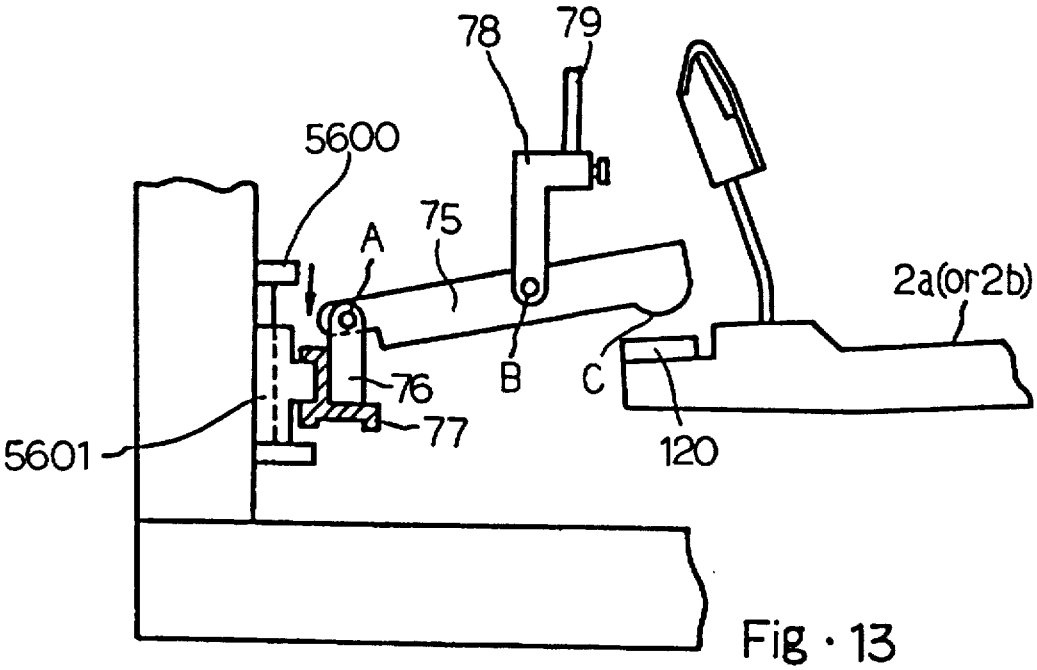
FIGS. 13 and 14 are partially cross sectional side views showing a first modification of the make-up mechanism.
Figure 14:
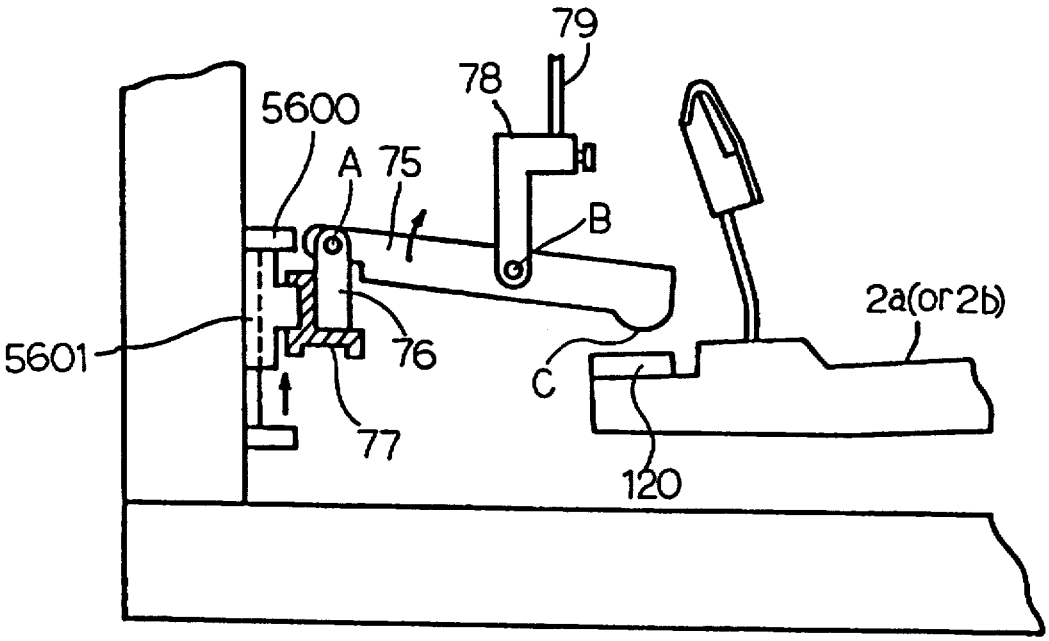

FIGS. 13 and 14 illustrate a first modification of the make-up mechanism in the acoustic sound mode. FIG. 13 shows the first modification in the acoustic sound mode, and FIG. 14 shows the silent mode. The first modification comprises a guide member 5600 fixed to a board member of the grand piano, a slider 5601 slidable supported by the guide member 5600 and supporting the damper lever rail 77 and a driver (not shown) implemented by, for example, a nob or an electric motor. The damper flanges 76 are mounted on the damper lever rail 77, and the damper levers 75 are rotatably supported at point A by the damper flanges 76. The damper blocks 78 are rotatably connected at point B to the damper levers 75, and the damper wires 79 project from the damper blocks 78, respectively. The felt members 120 are respectively attached to the rear end portions of the keys 2a and 2b, and are brought into contact with the damper levers 75 at point C.

Figure 15A:
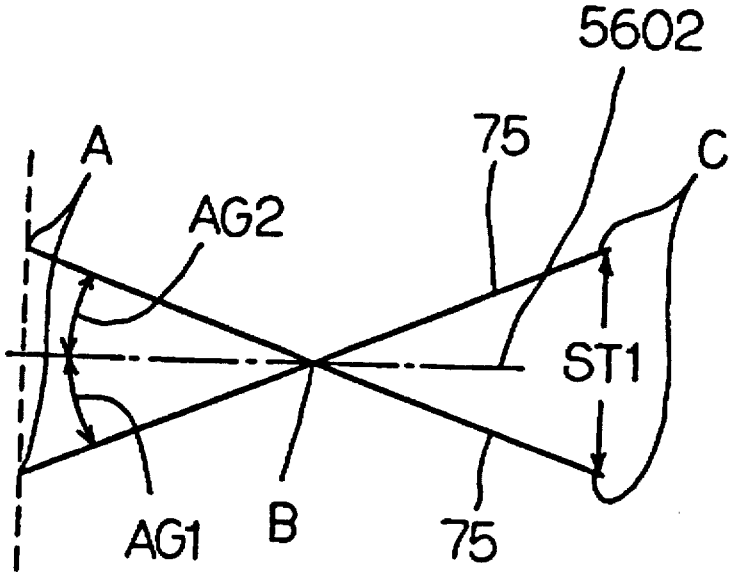
FIGS. 15A and 15B are diagrams showing functions of the first modification.

The slider 5601 is held in contact with the lower dead point of the guide member 5600 in the acoustic sound mode, and the damper levers 75 turned around the point B. For this reason, the point C is maintained at an upper dead point. If the slider 5601 is moved to the upper dead point along the guide member 5600, the point A is pulls up, and the damper levers turns around the point B in the clockwise direction. As a result, the point C is lowered as shown in FIG. 15A. The stroke ST1 of the point C is adjusted to the distance over which the change-over mechanism changes the felt member 120 between the acoustic sound mode and the silent mode. For this reason, the first modification keeps the distance between the felt member 120 and the damper lever 75 constant.

Figure 15B:
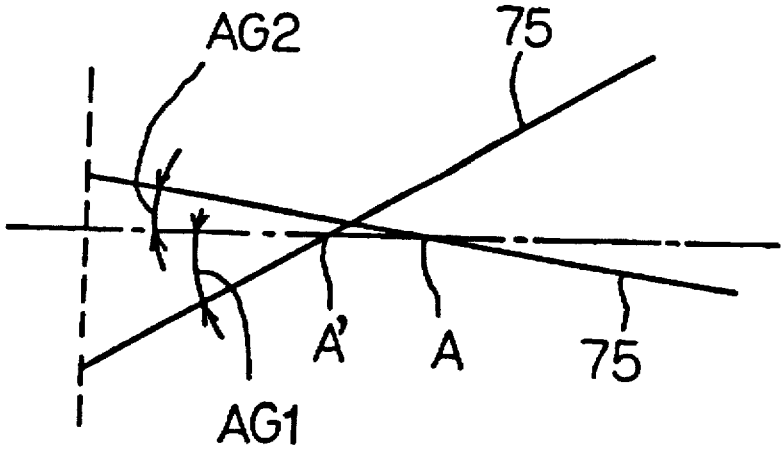

In this instance, an angle AG1 between the damper lever 75 and a horizontal line 5602 in the acoustic sound mode is equal to an angle AG2 between the damper lever 75 and the horizontal line 5602 in the silent mode. If the angle AG1 is different from the angle AG2 as shown in FIG. 15B, the point A is laterally moved to a point A', and the damper wires 79 are declined.

The first modification is simple, and allows the manufacturer to reduce the production cost. Moreover, the first modification is free from noise due to the sliders 112 and 5504, and the load is not changed, because the felt member 120 is directly brought into contact with the damper lever 75.

Figure 16:
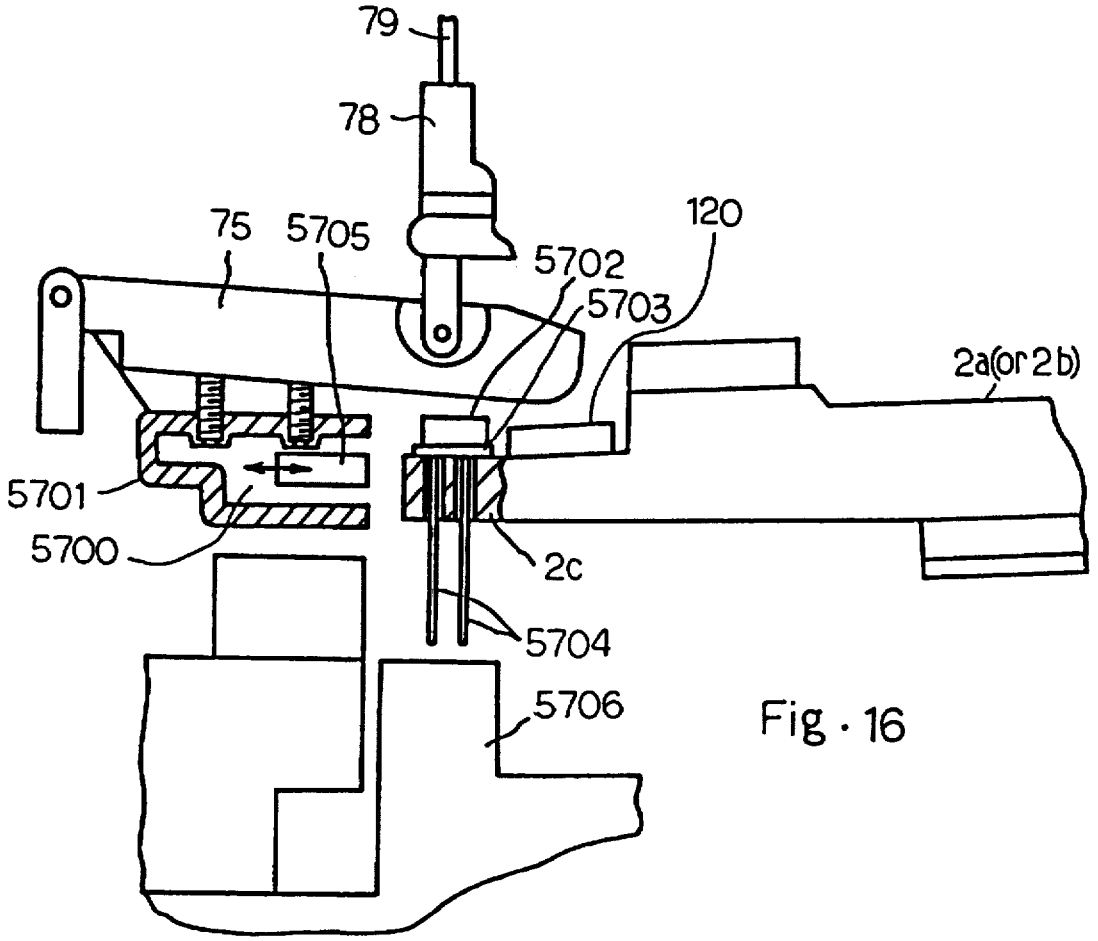
FIGS. 16 and 17 are partially cross-sectional side views showing a second modification of the make-up mechanism.
Figure 17:
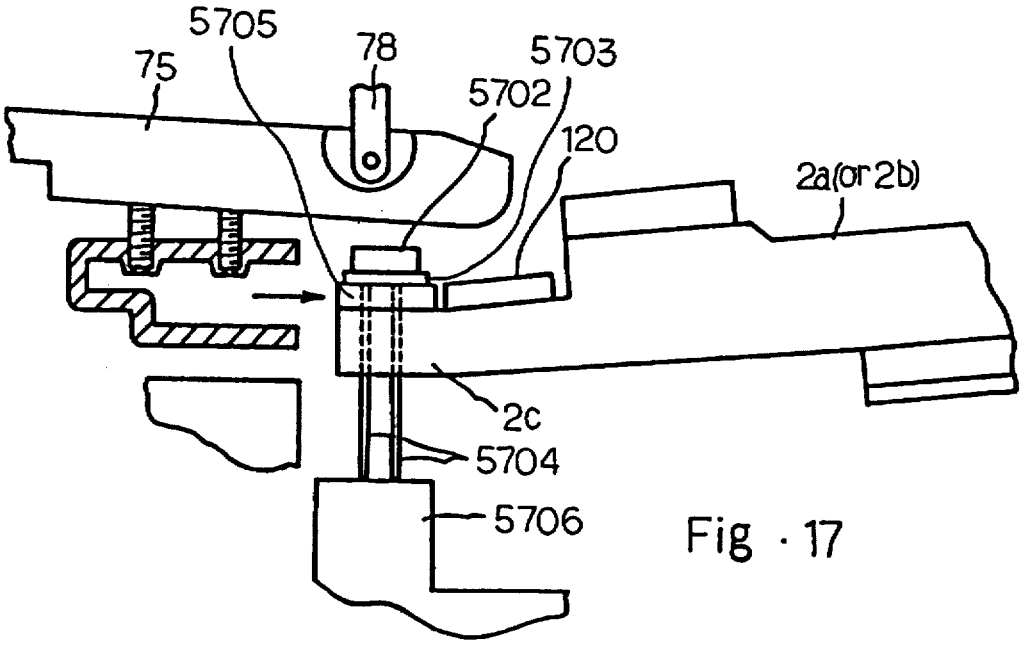

FIG. 16 shows a second modification in the acoustic sound mode, and FIG. 17 shows the second modification in the silent mode. The key 2a/2b is backwardly elongated, and the elongated portion 2c in the rest position is aligned with an inner space 5700 of a lifting rail 5700 in acoustic sound mode as shown in FIG. 16. The second modification comprises an auxiliary felt member 5702 mounted on a plate 5703 movable under the guide of pin members 5704, a spacer 5705 insertable between the plate member 5703 and the elongated portion 2c, a bracket member 5706 mounted on the stationary key bed 1a and a transfer mechanism (not shown) for laterally moving the spacer 5705 between an idling position (see FIG. 16) in the inner space 5700 and a working position (see FIG. 17) between the plate member 5703 and the elongated portion 2c.

While the movable key bed 1b is maintained in the upper position, the pin members 5704 are spaced from the bracket member 5706, and the plate member 5703 is held in contact with the elongated portion 2c. In this situation, the felt member 120 is brought into contact with the damper lever 75, and actuates the damper mechanism 40.

On the other hand, when the keyboard musical instrument is changed to the silent mode, the movable key bed 1b and the key 2a/2b are lowered, and the pin members 5704 are pressed against the bracket member 5706. As a result, the plate member 5703 and the auxiliary felt member 5702 are lifted and spaced from the elongated portion 2c. Then, the transfer mechanism conveys the spacer 5705 into the gap between the plate member 5703 and the elongated portion 2c. In this situation, if the key 2a/2b is depressed, the auxiliary felt member 5702 is brought into contact with the damper lever 75, and actuates the damper mechanism 40 as similar to in the acoustic sound mode. The gap between the felt member 120 and the damper lever 75 in the acoustic sound mode is equal to the gap between the auxiliary felt member 5702 and the damper lever 75 in the silent mode, and, for this reason, the damper mechanism 40 is actuated at a predetermined timing between the acoustic sound mode and the silent mode.

The second modification achieves all of the advantages of the first and second embodiments and all the advantages of the first modification.

Figure 18:
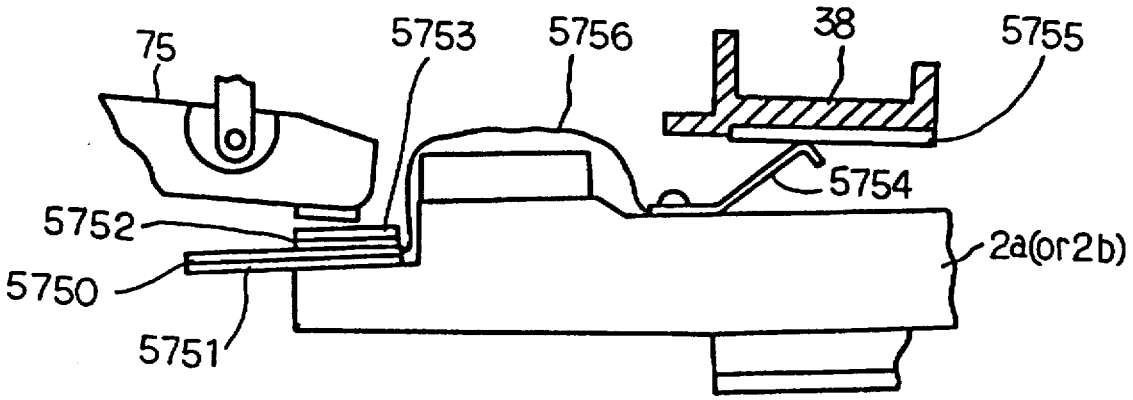
FIGS. 18 and 19 are partially cross-sectional side views showing a third modification of the make-up mechanism.
Figure 19:
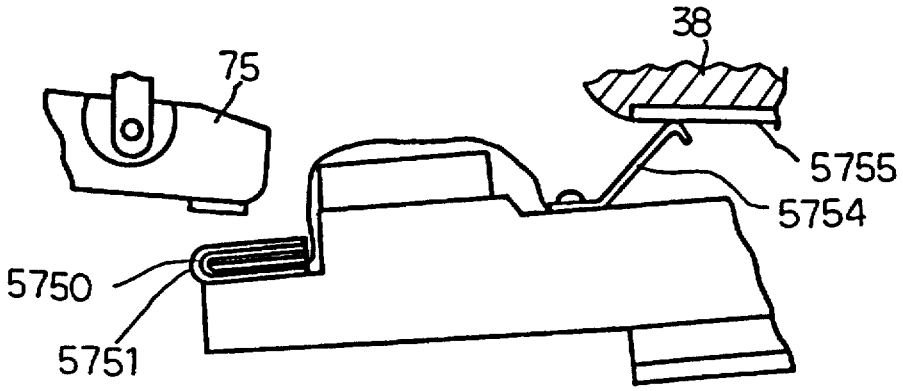
Figure 20:
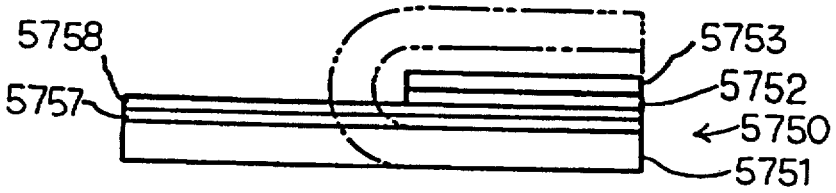
FIG. 20 is a side view showing a bimetal incorporated in the third modification.

FIGS. 18, 19 and 20 illustrates a third modification of the make-up mechanism. The third modification in the acoustic sound mode and the third modification in the silent mode are illustrated in FIGS. 18 and 19, respectively. The third modification comprises a bimetal 5750 fixed to a felt sheet 5751 partially bonded to the rear end portion of the key 2a/2b, a heater 5752 provided on a front half of the bimetal 5750, a cushion sheet 5753 attached to the upper surface of the heater 5752, a conductive leaf spring 5754 bolted to the key 2a/2b and a rigid circuit board 5755 fixed to the lower surface of the whippen rail 38 and a lead 5756 connected between the conductive leaf spring 5754 and the heater 5752. Though not shown in the figures, a conductive area is patterned on the rigid circuit board 5755, and the conductive area and the heater 5752 are connected to a source of electric power.

As will e seen from FIG. 20, the bimetal 5750 is implemented by a lower metal strip 5757 with a large thermal expansion coefficient and an upper metal strip 5758 with a small thermal expansion coefficient.

While the movable key bed 1b is staying in the upper position in the acoustic sound mode, the leaf string 5754 is spaced from the conductive area on the rigid circuit board 5755, and heater 5752 does not generate heat.

On the other hand, when the movable key bed 1b is lowered in the silent mode, the conductive leaf spring 5754 is brought into contact with the conductive area of the rigid circuit board 5755, and current flows through the heater 5752. Then, the heater 5752 increases the temperature, and the bimetal 5750 is turned back as shown in FIG. 19. The thickness of the lamination 5750/5751/5752/5753 is increased, and the difference is regulated to the movement of the movable key bed 1b. Thus, the damper lever 75 is actuated at a predetermined timing in both acoustic sound and silent modes.

The third modification is free from noise, and achieves all of the advantages.

Figure 21:
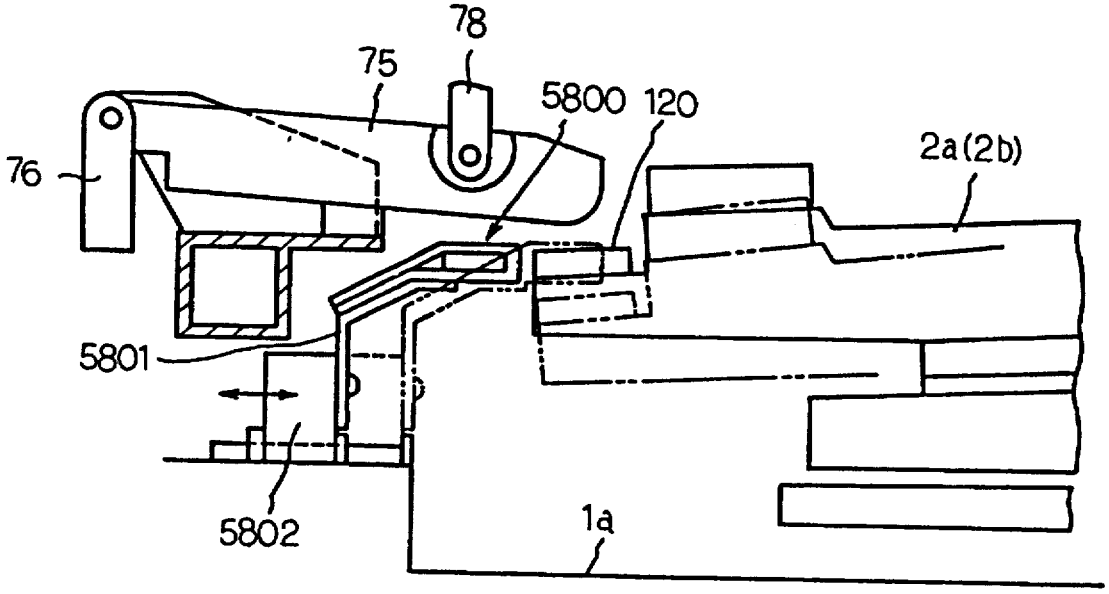
FIG. 21 is a partially cross-sectional side view showing a fourth modification of the make-up mechanism.
Figure 22:
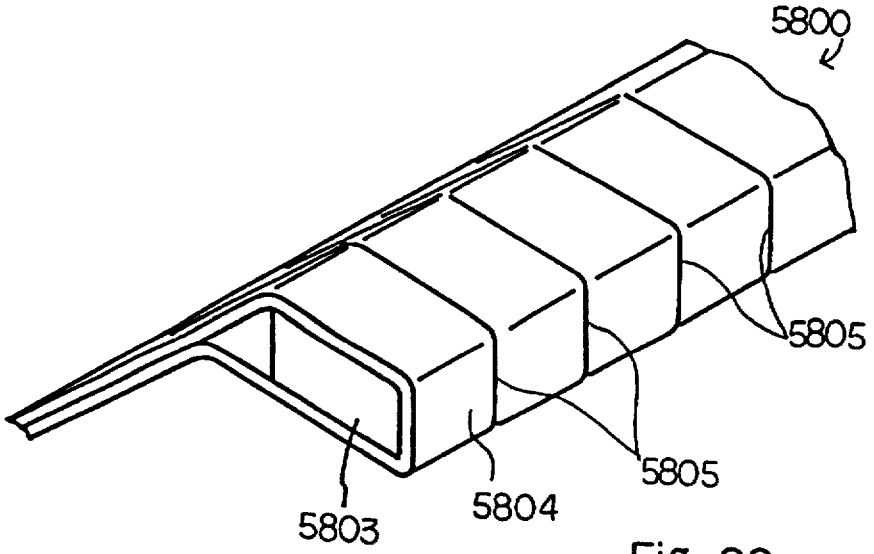
FIG. 22 is a perspective view showing a spacer incorporated in the fourth modification.

FIGS. 21 and 22 illustrate a fourth modification of the make-up mechanism, and the fourth modification comprises a plurality of deformable spacers 5800 respectively associated with the keys 2a and 2b, a bracket member for retaining the deformable spacers 5800, a slider 5802 slidable on the stationary key bed 1a and a driving unit (not shown) for changing the slider 5802 between a front position drawn by dots-and-dash line and a rear position drawn by a real line. A link mechanism or an electric motor is available for the driving unit.

As shown in FIG. 22, the spacers 5800 has an elongated felt member 5803 wrapped in a cloth 5804, and the felt member 5803 and the cloth 5804 are separated into the spacers 5800 by slits 5805. For this reason, each key 2a/2b can push up the associated spacer 5800 independently.

While the movable key bed 1b is staying in the upper position, the slider 5802 is maintained in the rear position, and the felt member 120 of the depressed key 2a/2b pushes up the damper lever 75. On the other hand, if the keyboard musical instrument enters into the silent mode, the movable key bed 1b is lowered, and the slider 5802 is moved to the front position. Then, the spacers 5800 are inserted into the gap between the felt members 120 and the damper levers 75, and the felt members 120 push up the spacers 5800 and the damper levers 75.

The fourth modification achieves all of the advantages of the present invention.

Figure 23:
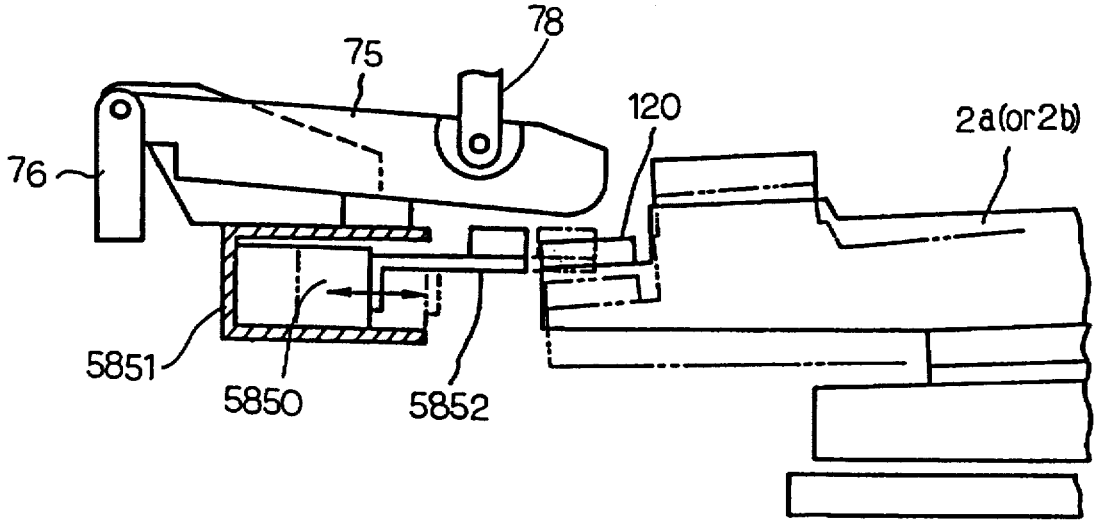
FIG. 23 is a partially-cross sectional side view showing a fifth modification of the make-up mechanism.
Figure 24:
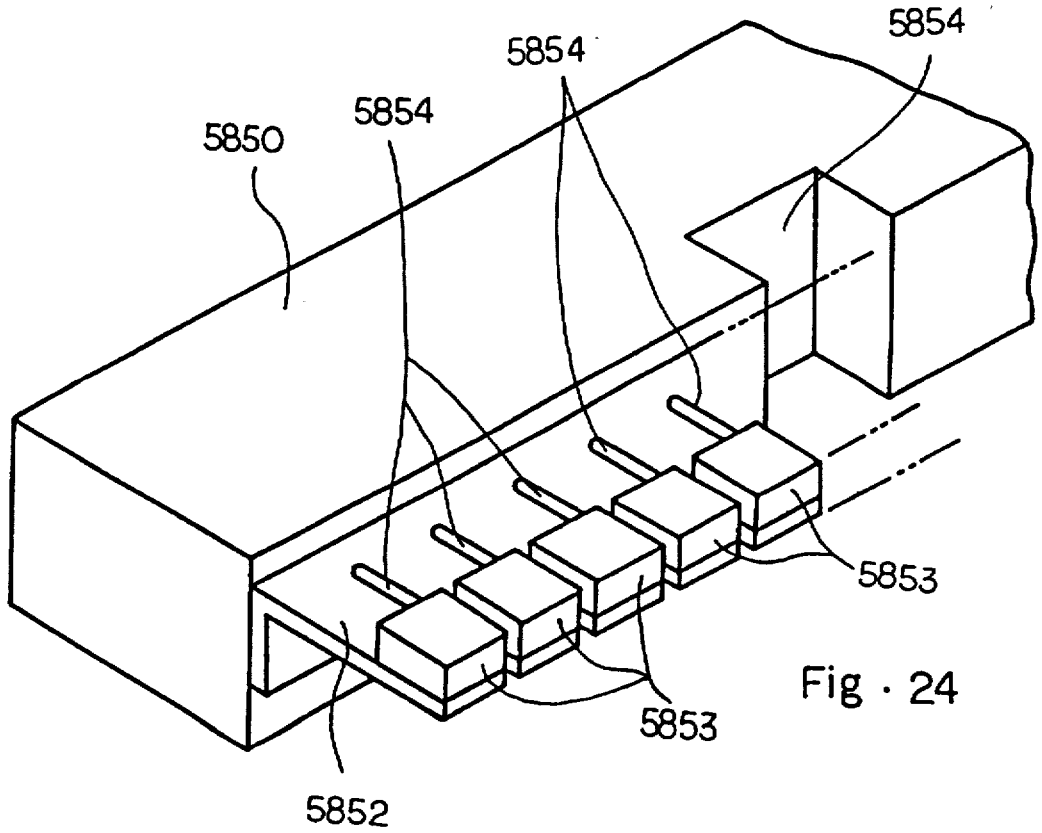
FIG. 24 is a perspective view showing spacers incorporated in the fifth modification.
Figure 25:
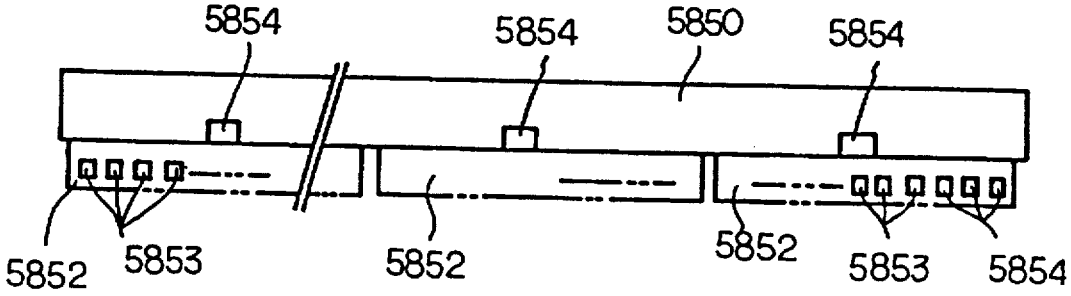
FIG. 25 is a plane view showing the fifth modification.

FIGS. 23, 24 and 25 illustrate a fifth modification of the make-up mechanism, and the fifth modification comprises a slider 5850 slidable with respect to a lifting rail 5851, retainers 5852 fixed to the slider 5850, a plurality of spacers 5853 provided on the retainer 5852 at intervals of 13 millimeters and a driving unit (not shown) for changing the spacer 5850 between a front position and a rear position.

As shown in FIG. 24, slits 5854 are formed in the retainer 5852, and the horizontal portion of the retainer 5852 are split into a plurality of fingers. The fingers are deformable, and the spacers 5853 are independently moved together with the associated fingers. Reinforcing plates (not shown) are provided inside of the lifting rail 5851, and the sliders 5850 have recesses 5854 so as to slide without interference of the reinforcing plates.

The slider 5850 is maintained at the rear position in the acoustic sound mode, and is changed to the front position in the silent mode. The fifth modification behaves as similar to the fourth modification, and achieves all of the advantages of the present invention.

Figure 26:
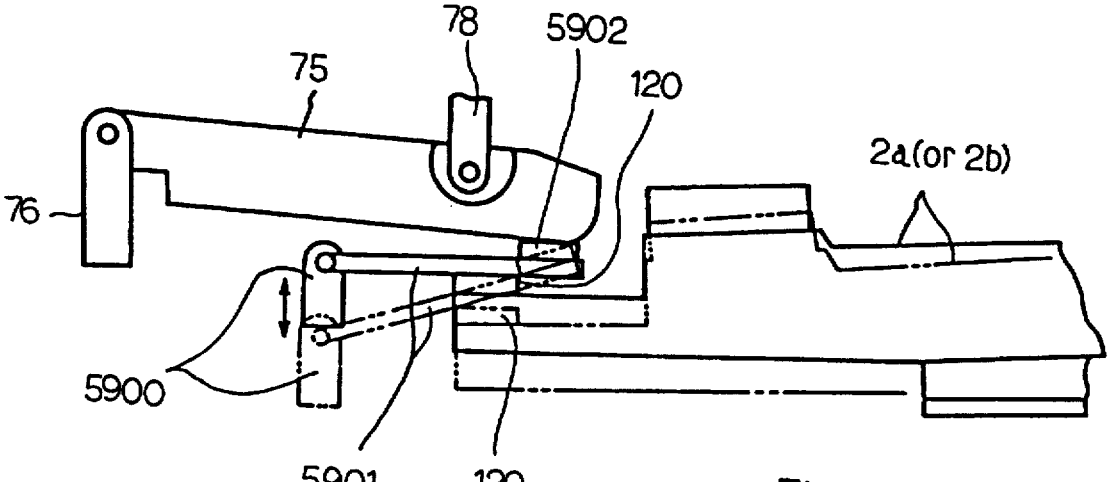
FIG. 26 is a side view showing a sixth modification of the make-up mechanism.

FIG. 26 illustrates a sixth modification of the make-up mechanism, and the sixth modification comprises flanges 5900, arm members 5901 rotatably supported by the flanges 5900 and felt members 5902 attached to the arm members 5901, and the flanges 5900 are changed between an upper position and a lower position. It is recommendable to form the arm members 5901 and the felt members 5902 as light as possible, because the weight of the arm member 5901 and the weight of the felt member 5902 are applied to the associated key 2a/2b at all times.

While the movable key bed 1b is staying in the upper position in the acoustic sound mode, the arm members 5901 are horizontally maintained as drawn by real lines, and the felt member 120 of the depressed key 2a/2b pushes the associated arm member 5901 and, accordingly, the felt member 5902. Then, the upward motion of the depressed key 2a/2b is transferred to the damper lever 75, and the damper mechanism is actuated.

On the other hand, when the movable key bed 1b is lowered in the silent mode, the flanges 5900 are also lowered, and the arm members 5901 are declined between the damper levers 75 and the felt members 120. If one of the keys 2a/2b is depressed, felt member 120 pushes up the arm member 5901, and the felt member 5902 transfers the upward motion to the damper lever 75. Thus, the arm members 5901 is declined for automatically making up the difference.

The sixth modification achieves all of the advantages of the present invention.

Figure 27:
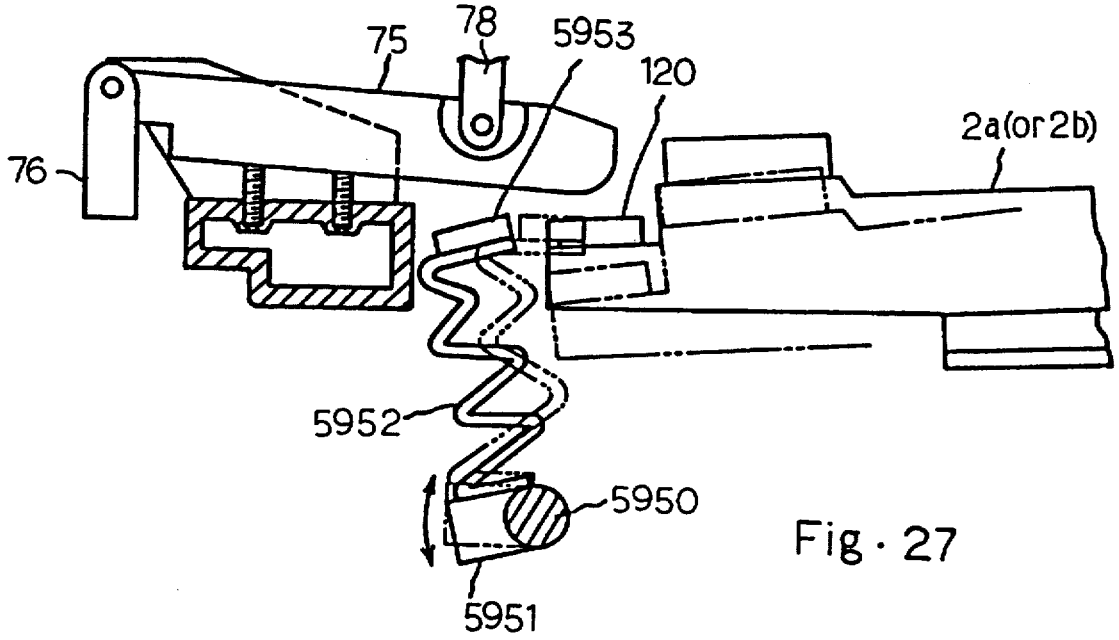
FIG. 27 is a partially cross-sectional side view showing a seventh modification of the make-up mechanism.
Figure 28:
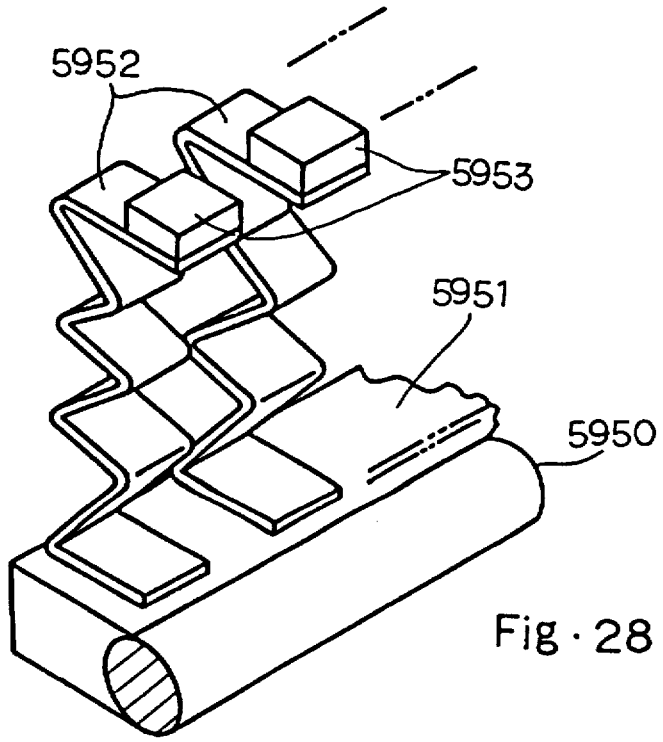
FIG. 28 is a perspective view showing the seventh modification.

FIGS. 27 and 28 illustrates a seventh modification of the make-up mechanism, and the seventh modification comprises a rotatable shaft member 5950, a bracket member 5951, a plurality of spring members 5952 each shaped into bellows, a plurality of spacers 5953 of felt attached to the spring members 5952 and associated with the keys 2a and 2b and a driver unit (not shown) for bi-directionally rotating the shaft member 5951.

While the keyboard musical instrument is in the acoustic sound mode, the spacers are maintained out of the trajectories of the felt members 120, and the felt members 120 directly push up the damper levers 75.

On the other hand, if the movable key bed 1b is lowered in the silent mode, the driver unit rotates the shaft member 5950 in the clockwise direction, and the spacers 5953 are inserted in the gap between the felt members 120 and the damper levers 75. For this reason, the felt member 120 pushes up the damper lever 75 through the spacer 5953, and the spring member 5952 is expanded so as to allow the spacer 5953 to transfer the motion of the key to the damper lever 75.

The seventh modification achieves all of the advantages of the present invention.

Figure 29:
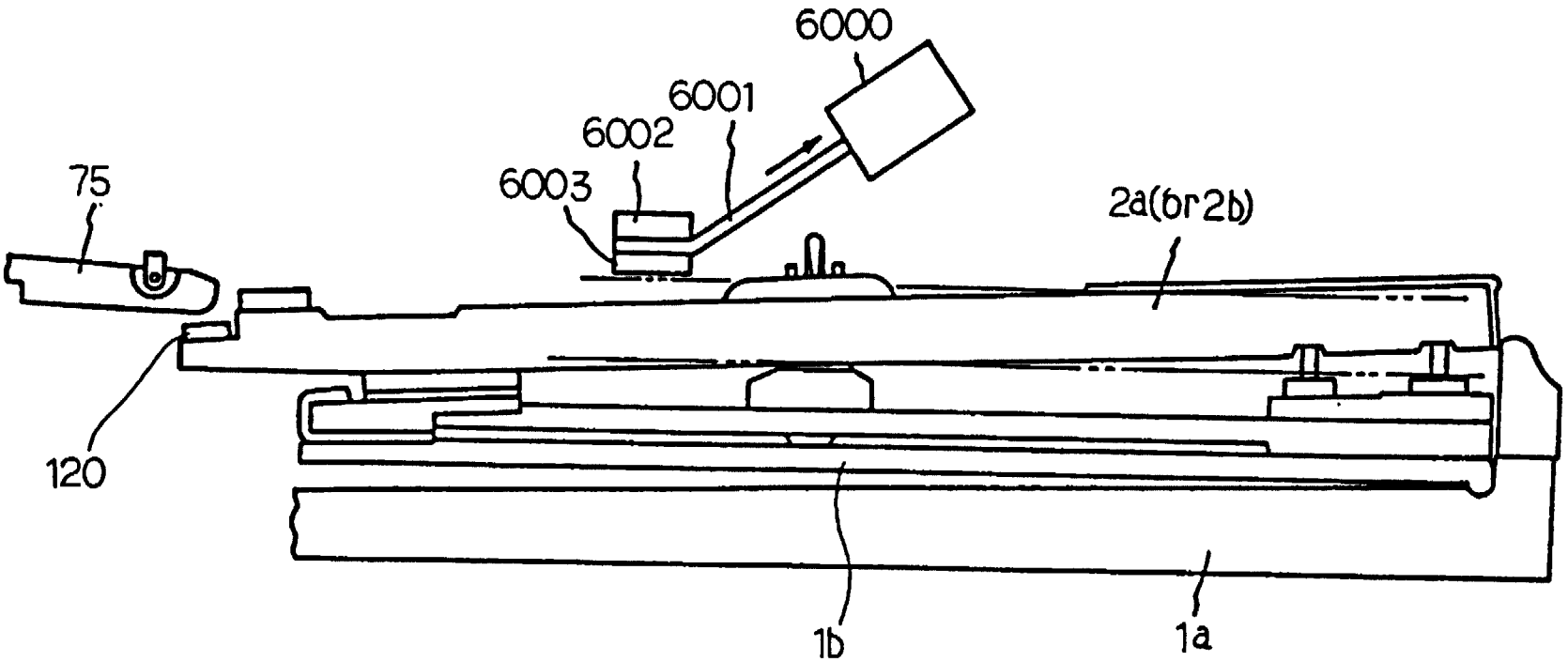
FIGS. 29 and 30 are partially cross-sectional side views showing a dummy weight incorporated in a keyboard musical instrument according to the present invention instead of the make-up mechanism.
Figure 30:
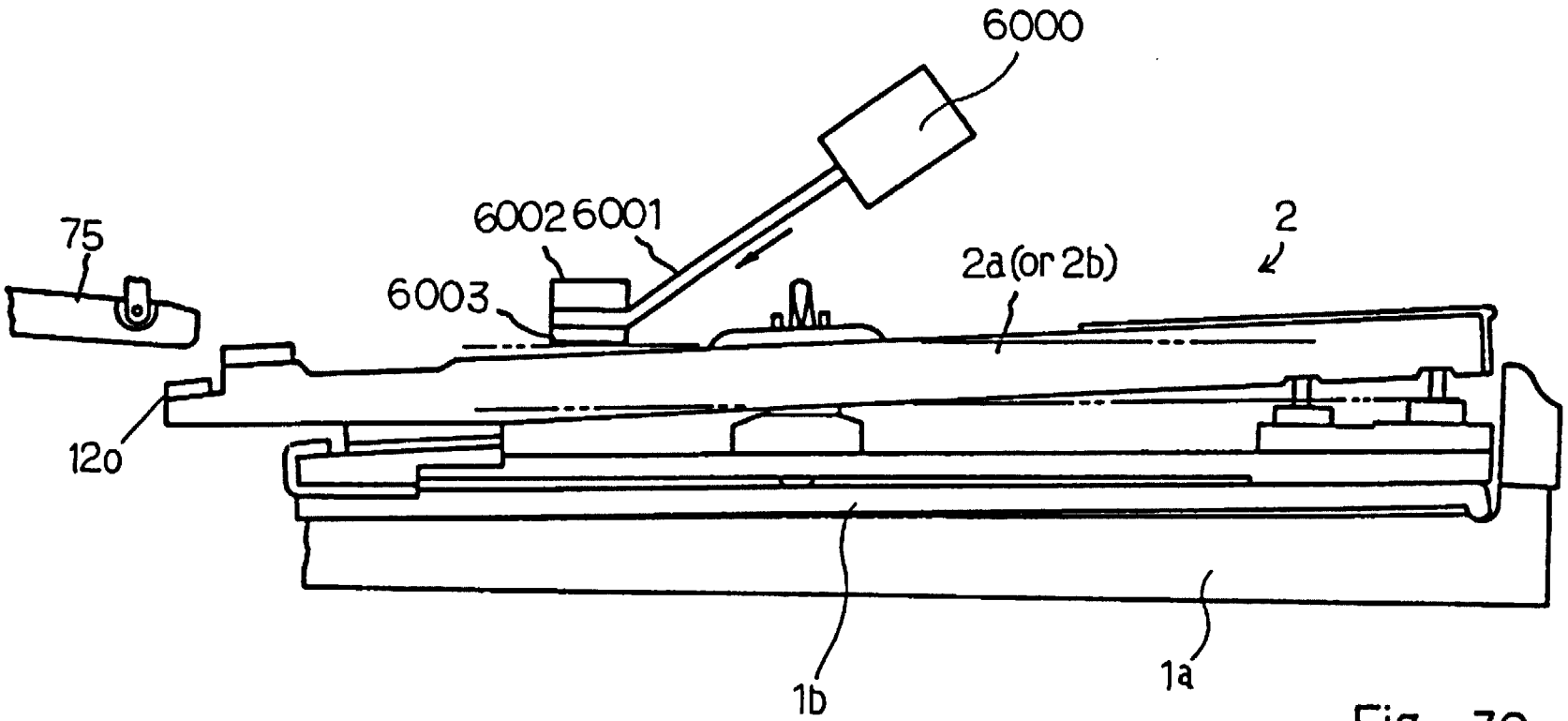

FIGS. 29 and 30 illustrate a dummy weight used in a keyboard musical instrument according to the present invention instead of the make-up mechanism. The dummy weight comprises an actuator unit 6000 implemented by a solenoid-operated actuator unit or an electric motor unit, a plurality of elastic plates 6001 driven by the actuator unit 6000, a plurality of weight members 6002 attached to the upper surfaces of the elastic plates 6001 and cushion members 6003 attached to the lower surfaces of the elastic plates 6001.

The movable key bed 1b is turnable with respect the stationary key bed 1a, and the keyboard 2, key action mechanisms (not shown) and the hammer mechanisms (not shown) are moved together with the movable key bed 1b. In this instance, the movable key bed 1b turns only 1 degree. While the movable key bed 1b is staying in the upper position, the actuator unit 6000 retracts the elastic plates 6001, and the keys 2a and 2b are not brought into contact with the cushion members 6003.

On the other hand, when the movable key bed 1b is changed to the lower position, the elastic plates 6001 project toward the keys 2a and 2b, and the depressed keys 2a and 2b are brought into contact with the cushion members 6003 on the way toward the rest positions. The elastic plate and the weight member 6002 apply a force equivalent to the weight of the associated damper mechanism, and the player feels the key touch as usual. The depressed key 2a/2b comes in contact with the cushion member 6003 in the silent mode at the same angular position as the key brought into contact with the damper lever 75 in the acoustic sound mode.

The movable key bed 1b may be moved in the up-and-down direction by using the worm/worm wheels, the jacks/solenoid-operated actuators or an electric motor in the modification using the dummy weight.

Although particular embodiments of the present invention have been shown and described, it will be obvious to those skilled in the art that various changes and modifications may be made without departing from the spirit and scope of the present invention. For example, the movable key bed, the stopper mechanism, the make-up mechanism are available for an upright piano and an automatic player piano fabricated on the basis of an upright piano. The stopper may be rotatable, swingable or laterally shiftable for changing the position between the acoustic sound mode and the silent mode. The stationary key bed may be deleted, and the movable key bed is moved with respect to a stationary member of a piano.

What is claimed is:

1. A keyboard musical instrument having at least an acoustic sound mode and a silent mode comprising:

an acoustic piano comprising:

a key bed structure including a movable key bed and a stationary key bed, said movable key bed being movable with respect to said stationary key bed, a keyboard including a plurality of swingable keys for being depressed by a player in both said acoustic sound mode and said silent mode, notes of a scale being assigned to each of said keys, respectively, a plurality of hammer assemblies, a plurality of key action means for functionally connecting respective ones of said plurality of hammer assemblies to respective ones of said keys and for selectively driving respective ones of said plurality of hammer assemblies along trajectories in response to respective ones of said keys being depressed, a plurality of sets of strings respectively associated with respective ones of said plurality of hammer assemblies, wherein respective ones of said plurality of said hammer assemblies strike respective ones of said plurality of sets of strings while said keyboard musical instrument is in said acoustic sound mode in response to respective ones of said keys being depressed, and a plurality of damper assemblies respectively associated with respective ones of said plurality of sets of strings and keys, each said damper assembly comprising a contact means for contacting a respective one of said plurality of sets of strings and a lever means for disengaging said contact means from contacting said respective one of said plurality of sets of strings in response to a respective one of said plurality of keys being depressed while said keyboard musical instrument is in at least said acoustic sound mode;

said keyboard musical instrument further including:

electronic sound generating means for producing electronic sounds in response to ones of said plurality of keys being depressed while said keyboard musical instrument is in said silent mode; and change over means for selecting between said acoustic sound mode and said silent mode by positioning said movable key bed an upper position in said acoustic sound mode and in a lower position in said silent mode, said lower position creating a gap between said plurality of damper assemblies and said plurality of keys;

stopper means movable between a free position and a blocking position for permitting said plurality of hammer assemblies to strike said plurality of sets of strings while positioned in said free position and for blocking said plurality of hammer assemblies from striking said plurality of sets of strings while in said blocking position by moving into said trajectory of said hammer assemblies, said stopper means comprising:

a movable stopper, an oblique guide extending toward a front and rear of said acoustic piano, slider means connected to said movable stopper for reciprocally sliding along said oblique guide, a plurality of cushion members attached to ones of said hammer assemblies, said movable stopper being in said trajectories of said plurality of hammer assemblies so as to contact said cushion members when said stopper means is in said blocking position, and means for positioning said movable stopper while in said blocking position such that a distance between each of said plurality of hammer assemblies at a home position and said associated ones of said plurality of sets of strings when said keyboard instrument is in said acoustic sound mode is approximately equal to a distance between each of said plurality of hammer assemblies at said home position and said movable stopper when said keyboard instrument is in said silent mode; and a plurality of dummy weight means respectively associated with ones of said plurality of keys for providing loads to depressed ones of said plurality of keys while said keyboard instrument is in said silent mode.

2. A keyboard musical instrument having at least an acoustic sound mode and a silent mode comprising:

an acoustic piano comprising:

a key bed structure including a movable key bed and a stationary key bed, said movable key bed being movable with respect to said stationary key bed, a keyboard including a plurality of swingable keys for being depressed by a player in both said acoustic sound mode and said silent mode, notes of a scale being assigned to each of said keys, respectively, a plurality of hammer assemblies, a plurality of key action means for functionally connecting respective ones of said plurality of hammer assemblies to respective ones of said keys and for selectively driving respective ones of said plurality of hammer assemblies along trajectories in response to respective ones of said keys being depressed, a plurality of sets of strings respectively associated with respective ones of said plurality of hammer assemblies, ones of said plurality of said hammer assemblies striking respective ones of said plurality of sets of strings while said keyboard musical instrument is in said acoustic sound mode in response to respective ones of said keys being depressed, and a plurality of damper assemblies respectively associated with ones of said plurality of sets of strings and keys, each said damper assembly comprising a contact means for contacting a respective one of said plurality of sets of strings and a lever means for disengaging said contact means from contacting said respective one of said plurality of sets of strings in response to a respective one of said plurality of keys being depressed while said keyboard musical instrument is in at least said acoustic sound mode;

said keyboard musical instrument further including:

electronic sound generating means for producing electronic sounds in response to ones of said plurality of keys being depressed while said keyboard musical instrument is in said silent mode;

change over means for selecting between said acoustic sound mode and said silent mode by positioning said movable key bed in an upper position in said acoustic sound mode and in a lower position in said silent mode, said lower position creating a gap between said plurality of damper assemblies and said plurality of keys; and stopper means movable between a free position and a blocking position for permitting said plurality of hammer assemblies to strike said plurality of sets of strings while positioned in said free position and for blocking said plurality of hammer assemblies from striking said plurality of sets of strings while in said blocking position by moving into said trajectory of said hammer assemblies, said stopper means comprising:

a movable stopper, an oblique guide extending toward a front and rear of said acoustic piano, slider means connected to said movable stopper for reciprocally sliding along said oblique guide, and a plurality of cushion members attached to ones of said hammer assemblies, said movable stopper being in said trajectories of said plurality of hammer assemblies so as to contact said cushion members when said stopper means is in said blocking position; and make-up means for decreasing said gap between said plurality of damper assemblies and said plurality of keys while said keyboard musical instrument is in said silent mode.

3. The keyboard musical instrument as set forth in claim 2, wherein said stopper means further comprises means for positioning said movable stopper while in said blocking position such that a distance between each of said plurality of hammer assemblies at a home position and said associated ones of said plurality of sets of strings when said keyboard instrument is in said acoustic sound mode is approximately equal to a distance between each of said plurality of hammer assemblies at said home position and said movable stopper when said keyboard instrument is in said silent mode.

4. The keyboard musical instrument as set forth in claim 2, wherein said stopper means further includes means for positioning said movable stopper while in said blocking position such that a distance between each of said plurality of hammer assemblies at a home position and said associated ones of said plurality of sets of strings when said keyboard instrument is in said acoustic sound mode is approximately equal to a distance between each of said plurality of cushion members attached to ones of said plurality of hammer assemblies at said home position and said movable stopper while said keyboard instrument is in said silent mode.

5. The keyboard musical instrument as set forth in claim 2, wherein said change over means includes means for moving said movable key bed between said upper position and said lower position through a reciprocal motion of said movable key bed.

6. The keyboard musical instrument as set forth in claim 2, further comprising a plurality of solenoid operated actuator means associated with ones of said plurality of keys for selectively actuating associated ones of said key action means and for being selectively driven by said electronic sound generating system while in a playback mode.

7. The keyboard musical instrument as set forth in claim 2, wherein said make up means includes spacing means for rendering said gap between said plurality of damper assemblies and said plurality of keys while said keyboard musical instrument is in said silent mode approximately equal to a gap between said plurality of keys and said plurality of damper assemblies while said keyboard musical instrument is in said acoustic mode.

* * * * *